US012808623B2

(12) United States Patent
Speicher et al.

(10) Patent No.: US 12,808,623 B2
(45) Date of Patent: Nov. 24, 2026

(54) SYSTEMS FOR STABILIZING HANDHELD FIREARMS

(71) Applicants: John M Speicher, Geyserville, CA (US); Che Ram Souza Voigt, Geyserville, CA (US)

(72) Inventors: John M Speicher, Geyserville, CA (US); Che Ram Souza Voigt, Geyserville, CA (US)

( * ) Notice: Subject to any disclaimer, the term of this patent is extended or adjusted under 35 U.S.C. 154(b) by 0 days.

(21) Appl. No.: 19/070,117

(22) Filed: Mar. 4, 2025

(65) Prior Publication Data

US 2025/0314446 A1 Oct. 9, 2025

Related U.S. Application Data

(60) Provisional application No. 63/561,273, filed on Mar. 4, 2024.

(51) Int. Cl.
*F41A 27/30* (2006.01)
*F41C 23/10* (2006.01)
*F41G 3/12* (2006.01)

(52) U.S. Cl.
CPC ..... *F41A 27/30* (2013.01); *F41C 23/10* (2013.01); *F41G 3/12* (2013.01)

(58) Field of Classification Search
CPC ..... F41A 27/30; F41A 27/28; F41A 27/02; F41G 5/00; F41G 5/08; F41C 23/12
See application file for complete search history.

(56) References Cited

U.S. PATENT DOCUMENTS 5,631,437 A * 5/1997 LaVigna ..... F41A 27/30 89/14.05
5,834,677 A * 11/1998 Muller ..... F41A 27/30 89/41.17
5,974,940 A * 11/1999 Madni ..... F41G 3/22 89/41.17
8,453,368 B2 * 6/2013 Bockmon ..... F41G 3/165 235/407

(Continued)

OTHER PUBLICATIONS

Mathew Moss; The U.S. Army Is Testing Aim-Stabilized Weapons; Oct. 24, 2016; Popular Mechanic (Year: 2016).*

(Continued)

*Primary Examiner* — Joshua E Freeman
(74) *Attorney, Agent, or Firm* — Seager, Tufte & Wickhem LLP

(57) ABSTRACT

Firearm systems are provided. Illustrative firearm systems may be handheld and include or be configured to be used with a firearm. The firearm may have a barrel, a hammer release, and a buffer tube. The buffer tube may be in-line with the barrel and proximal of the hammer release. The firearm system may include a stabilization system configured to receive the firearm. The stabilization system may include a housing configured to extend around the barrel and the buffer tube, a pivot mount configured to receive the buffer tube, a motor system, and a controller. The motor system may be configured to adjust the barrel relative to the housing. The controller may be configured to receive a user selection of a mode from a plurality of predetermined modes and control the motor system based on the mode selected to adjust the barrel relative to the housing.

20 Claims, 13 Drawing Sheets

(56) References Cited

U.S. PATENT DOCUMENTS

| | | | | |
|---|---|---|---|---|
| 8,601,736 | B2 * | 12/2013 | Andersson | F41C 23/12 42/75.03 |
| 9,033,232 | B2 * | 5/2015 | Bockmon | F41G 3/165 235/407 |
| 9,395,155 | B1 * | 7/2016 | Bockmon | F41G 3/005 |
| 10,996,026 | B1 * | 5/2021 | Sitrick | G06V 10/764 |
| 11,274,904 | B2 * | 3/2022 | Dwyer | F41A 27/28 |
| 11,499,791 | B2 * | 11/2022 | Keeney | F41A 17/46 |
| 11,994,366 | B2 * | 5/2024 | Sitrick | F41G 3/02 |
| 2012/0042559 | A1 * | 2/2012 | Bockmon | F41A 27/30 235/404 |
| 2014/0332589 | A1 * | 11/2014 | Bockmon | F41G 3/005 235/407 |
| 2019/0137219 | A1 * | 5/2019 | Bockmon | F41G 5/16 |
| 2021/0131766 | A1 * | 5/2021 | Dwyer | F41G 5/14 |
| 2021/0389071 | A1 * | 12/2021 | Sitrick | G06N 3/08 |
| 2021/0389099 | A1 * | 12/2021 | Bilbrey | F41G 3/02 |

OTHER PUBLICATIONS

Nathaniel F, "AimLock Stabilized Weapon Platform Displayed at [AUSA 2017]", available online at: <https://www.thefirearmblog.com/blog/2017/10/31/aimlock-stabilized-weapon-platform-displayed-ausa-2017/>, Oct. 31, 2017, 7 pages.

Red Moose Hunting, "Gyro Stabilized Gunstock From Fixpoint—Iwa Outdoor Classic 2022", available online at: <https://www.youtube.com/watch?v=ZI8Xa_Xz-qs>, Mar. 29, 2022, 5 pages.

* cited by examiner 10
34
36
54
50
52
12
14
24
32
56
48
46
18
20
26

10
14
12
24
32
44
26
56
60
18
30
36
34
58
52
22

SYSTEMS FOR STABILIZING HANDHELD FIREARMS

CROSS REFERENCE TO RELATED APPLICATIONS

This application claims the benefit of U.S. Provisional Patent Application Ser. No. 63/561,273 filed on Mar. 4, 2024, the disclosure of which is incorporated herein by reference.

TECHNICAL FIELD

The present disclosure pertains to firearm systems, and the like. More particularly, the present disclosure pertains to systems configured to stabilize firearms during use, and methods for manufacturing and using such systems.

BACKGROUND

A wide variety of devices have been developed for use with firearms. These devices are manufactured by any one of a variety of different manufacturing methods and may be used according to any one of a variety of methods. Of the known firearm devices and methods, each has certain advantages and disadvantages.

BRIEF SUMMARY

This disclosure provides design, material, manufacturing method, and use alternatives for firearm systems. Although it is noted that firearm systems are known, there exists a need for improvement on those approaches and systems.

An example may include a handheld firearm system including a rifle comprising a barrel, a hammer release, and a buffer tube, the buffer tube is in-line with the barrel and extending proximal of the hammer release, and a stabilization system coupled with the rifle, the stabilization system comprising a housing extending around the barrel and the buffer tube, a pivot mount at a location proximal of the hammer release, wherein the pivot mount receives the buffer tube and pivots with the buffer tube about one or more axes relative to the housing, a motor system coupled with the buffer tube and configured to adjust the barrel relative to the housing, and a controller configured to receive a user selection of a mode from a plurality of predetermined modes and control the motor system based on the mode selected to adjust the barrel relative to the housing.

Alternatively or additionally to any of the embodiments in this section, the housing may include a buttstock, wherein the buttstock houses the motor system and the buffer tube extends into the buttstock, a hand stock fixed relative to the buttstock, wherein the barrel extends through the hand stock, and a pistol grip fixed relative to the buttstock and the hand stock.

Alternatively or additionally to any of the embodiments in this section, the stabilization system may further comprise a trigger configured to engage the hammer release of the rifle as the trigger is actuated and the trigger may be configured to move with the housing and the hammer release is configured to move with the rifle relative to the housing.

Alternatively or additionally to any of the embodiments in this section, the rifle may comprise a sighting system and the pivot mount is located proximal of the of the sighting system.

Alternatively or additionally to any of the embodiments in this section, the stabilization system may further comprise one or more space rate sensors in communication with the controller and the one or more sensors are configured to sense movement of the pivot mount about a first axis and a second axis of the one or more axes.

Alternatively or additionally to any of the embodiments in this section, the motor system may comprise a field assembly coupled to the buffer tube and comprising one or more magnets and a coil assembly coupled to the housing and comprising a first set of coils configured to adjust the rifle about a first axis of the one or more axes and a second set of coils configured to adjust the rifle about a second axis of the one or more axes.

Alternatively or additionally to any of the embodiments in this section, the handheld firearm system may further include an imbalance counter-torque system configured to maintain a desired balance torque on the rifle about a first axis of the one or more axes during operation of the rifle.

Alternatively or additionally to any of the embodiments in this section, the handheld firearm system may further include a lock having a first lock component rigidly fixed relative to the barrel and a second lock component coupled with the housing, wherein when the first lock component is engaged with the second lock component, the rifle may be configured to move with the housing and when the first lock component is disengaged from the second lock component, the rifle is configured to move relative the housing.

Alternatively or additionally to any of the embodiments in this section, the stabilization system may further comprise a control panel in communication with the controller and having one or more selectable buttons.

Alternatively or additionally to any of the embodiments in this section, the plurality of predetermined modes may include a rate stabilized mode, a stabilized position mode, and an automatic aiming mode.

Alternatively or additionally to any of the embodiments in this section, when the selected mode from the plurality of predetermined modes is an automatic aiming mode, the controller may be configured to initiate a visual directional indicator indicating a direction of movement of the housing to align the housing with the firearm.

In another example, a stabilization system may be configured to receive a rifle having a barrel, a buffer tube in-line with the barrel, and a hammer release, where the stabilization system may include a housing configured to receive the barrel and the buffer tube, a pivot mount configured to be proximal of the hammer release when the barrel and buffer tube are received in the housing, wherein the pivot mount is configured to receive the buffer tube and pivot about one or more axes relative to the housing, a motor system configured to couple with the buffer tube and adjust the barrel relative to the housing, and a controller configured to receive a user selection of a mode from a plurality of predetermined modes and control the motor system based on the mode selected to adjust the barrel relative to the housing.

Alternatively or additionally to any of the embodiments in this section, the housing may comprise a buttstock housing the motor system, wherein the buttstock is configured to receive the buffer tube and a hand stock rigidly fixed relative to the buttstock and configured to receive the barrel, wherein the rifle may be configured to pivot about the pivot mount in the one or more axes and relative to the buttstock and the hand stock.

Alternatively or additionally to any of the embodiments in this section, the stabilization system may include a pistol grip rigidly fixed relative to the buttstock and the hand stock and a trigger configured to engage the hammer release of the rifle as the trigger is actuated, wherein the trigger is configured to move with the housing and relative to the hammer release.

Alternatively or additionally to any of the embodiments in this section, the stabilization system may further include a linear actuator configured to maintain a desired torque on the rifle about a first axis of the one or more axes during operation of the rifle.

Alternatively or additionally to any of the embodiments in this section, the stabilization system may further include a lock having a first lock component configured to rigidly couple with the barrel and a second lock component coupled with the housing, wherein when the first lock component is engaged with the second lock component, the rifle may be configured to move with the housing and when the first lock component is disengaged from the second lock component, the rifle is configured to move relative the housing.

Alternatively or additionally to any of the embodiments in this section, the stabilization system may include a control panel in communication with the controller and having one or more selectable buttons, wherein the control panel may be covered when the first lock component is engaged with the second lock component and the control panel may be uncovered when the first lock component is disengaged from the second lock component.

In another example, a controller for a handheld stabilization system configured to stabilize a rifle coupled with a housing of the handheld stabilization system may include a processor and memory in communication with the processor, wherein the memory comprises instructions executed by the processor to cause the processor to perform operations comprising analyzing data from a sighting system, analyzing data from a distancing component, analyzing user input data received at the handheld stabilization system, and outputting a control signal configured to cause a directional indicator to be presented to a user, the directional indicator directing the user to adjust the housing to keep the housing aligned with a barrel of the rifle based on the data from the sighting system, the data from the distancing component, and the user input data.

Alternatively or additionally to any of the embodiments in this section, the user input data may comprise one or both of a gain adjustment selection and a selection of a mode of operation for the handheld stabilization system from a plurality of modes of operation for the handheld stabilization system stored in the memory, wherein the plurality of modes of operation for the handheld stabilization system may comprise one or more of a rate stabilized mode configured to cause the processor to output a control signal to a motor system to automatically maintain the barrel in a stabilized position in space as the housing moves, a stabilized position mode configured to cause the processor to output control signals to the motor system to automatically move the barrel in a direction of movement of the housing, and an automatic aiming mode configured to cause the processor to output control signals to the motor system to automatically move the barrel with movement of a target.

Alternatively or additionally to any of the embodiments in this section, the directional indicator may comprise a visual indicator on a user interface.

The above summary of some embodiments is not intended to describe each disclosed configuration or every implementation of the present disclosure. The Figures, and Detailed Description, which follow, more particularly exemplify these configurations.

BRIEF DESCRIPTION OF THE DRAWINGS

The disclosure may be more completely understood in consideration of the following detailed description in connection with the accompanying drawings.

Figure 1:
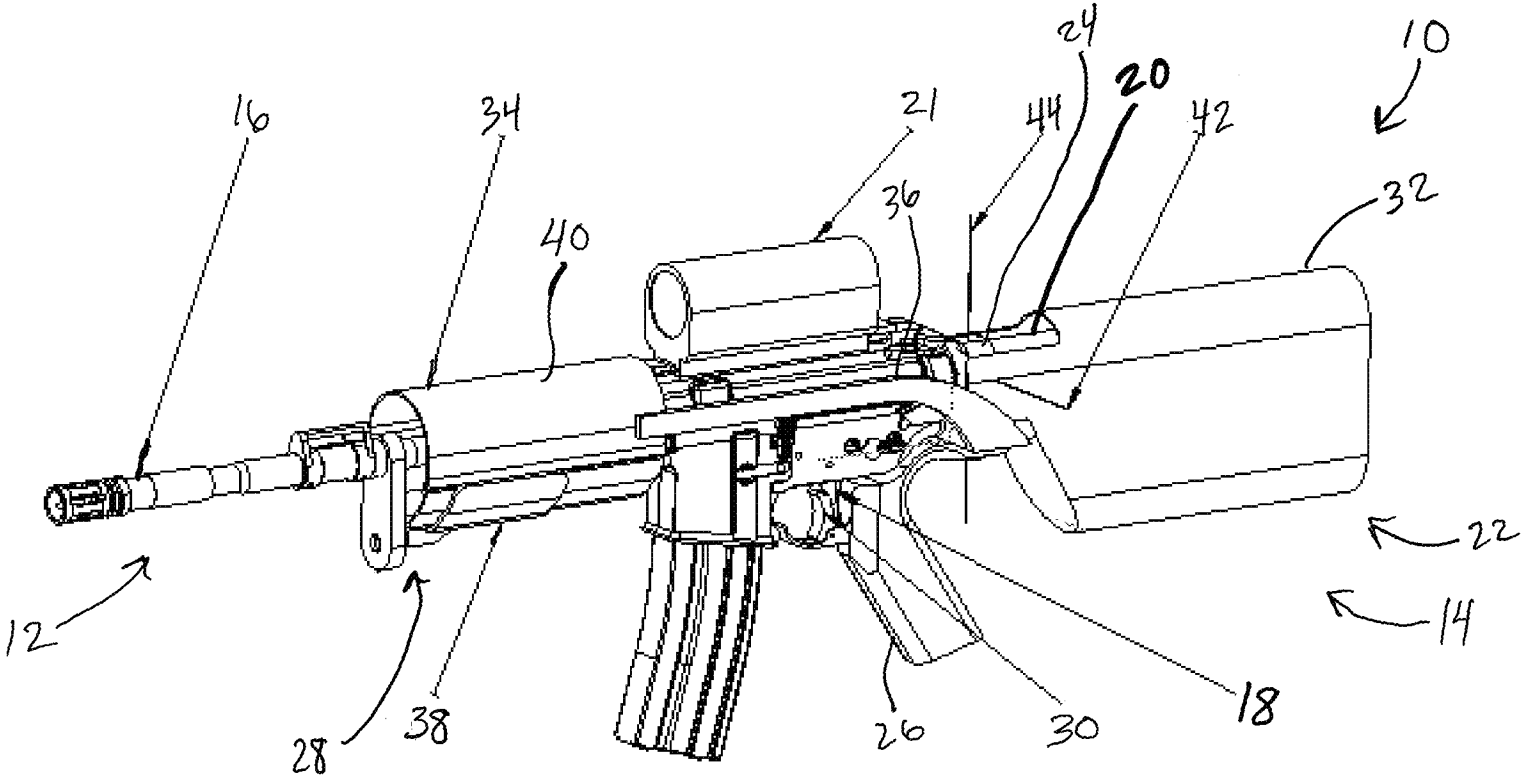
FIG. 1 depicts a schematic perspective view of an illustrative configuration of a firearm system.

While the disclosure is amenable to various modifications and alternative forms, specifics thereof have been shown by way of example in the drawings and will be described in detail. The intention is not to limit the invention to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "a configuration", "some configurations", "other configurations", etc., indicate that the configuration described may include one or more particular features, structures, and/or characteristics. However, such recitations do not necessarily mean that all configurations include the particular features, structures, and/or characteristics. Additionally, when particular features, structures, and/or characteristics are described in connection with one configuration, it should be understood that such features, structures, and/or characteristics may also be used in connection with other configurations whether or not explicitly described unless clearly stated to the contrary.

The following detailed description should be read with reference to the drawings in which similar structures in different drawings are numbered the same. The drawings, which are not necessarily to scale, depict illustrative embodiments and are not intended to limit the scope of the disclosure. Additionally, it should be noted that in any given figure, some features may not be shown, or may be shown schematically, for clarity and/or simplicity. Additional details regarding some components and/or method steps may be illustrated in other figures in greater detail. The devices and/or methods disclosed herein may provide a number of desirable features and benefits as described in more detail below.

Firearms, for example handheld firearms, may be pointed at a target by the hands of a user and then fired. Handheld firearms include, but are not limited to, pistols, revolvers, rifles, M4 rifles, M16, rifles, AR-15™-style rifles, and/or other firearms held and/or fired with the hands of a user. The M4 rifles, M16, rifles, and AR-15™-style rifles may be related as having the same or similar core design/components and may be referred to as the M4/M16/AR-15™-style family of rifles. In some examples, rifles of the M4/M16/AR-15™-style family of rifles may be air-cooled, gas-operated, magazine-fed rifles. Example components of rifles in the M4/M16/AR-15™-style family of rifles include, but are not limited to, a barrel, a buffer tube, a buttstock, a trigger, a hammer release that may be actuated to fire the rifle, a pistol grip, and/or other suitable components. In some examples, core components of rifles in the M4/M16/AR-15™-style family of rifles include, but are not limited to, a barrel, a hammer release, and a buffer tube in-line with the barrel. Although the disclosed concepts may be described with respect to rifles in the M4/M16/AR-15™-style family of rifles, it is contemplated that the disclosed concepts may be used with one or more other suitable firearms.

The concepts discussed herein may be configured to facilitate stabilizing and/or aiming a firearm during use. For example, the concepts discussed herein may be configured to facilitate stabilizing and/or aiming a rifle of the M4/M16/AR-15™-style family of rifles. When implemented or used with rifles in the M4/M16/AR-15™-style family of rifles, the disclosed concepts may enhance the functionality of the rifle by stabilizing the rifle relative to the user such that unintended movement of the barrel of the rifle due to user movement (e.g., breathing, tremors, environmental conditions, etc.) is mitigated. Mitigating the unintended movement of the barrel may improve the user's ability to hit (e.g., shoot) stationary targets and/or moving targets.

The concepts discussed herein may include a stabilization system that incorporates and/or is used with a firearm. In some examples, the stabilization system may include a housing, a pivot mount, a motor configured to adjust the firearm, and a controller in communication with the motor to facilitate stabilization and/or aiming the firearm during use. Additional and/or alternative components may be utilized as part of the stabilization system, as desired.

Turning to the figures, FIG. 1 depicts an illustrative configuration of a firearm system 10. In some examples, the firearm system 10 may include a firearm 12 and a stabilization system 14 (e.g., a handheld stabilization system or other suitable stabilization system). As depicted in FIG. 1 the stabilization system 14 may be configured to receive and/or may be coupled with the firearm 12. With the firearm 12 received in and/or coupled with the stabilization system 14, the stabilization system 14 may be configured to adjust (e.g., pivot, rotate, etc.) the firearm 12 relative to a housing 22 of the stabilization system 14 that a user may hold or grasp during use of the firearm system 10 to stabilize the firearm 12 relative to the user. Stabilizing the firearm 12 relative to the user may mitigate unintended movement of the firearm 12 due to user movement (e.g., breathing, tremors, environmental conditions, etc.). Mitigating the unintended movement of the firearm 12 may improve the user's ability to hit (e.g., shoot) stationary targets and/or moving targets.

The firearm 12 may be any suitable firearm. For example, the firearm 12 may be a handheld firearm, a pistol, a revolver, a rifle, a shotgun, and/or other suitable type of firearm. In some examples, the firearm 12 may include one or more barrels 16, one or more hammer releases, one or more buffer tubes 18, and/or other suitable components. In some examples, the firearm 12 may be configured as a handheld rifle in the M4/M16/AR-15™-style family of rifles, as depicted in FIG. 1. Example suitable firearms 12 configured as a rifle in the M4/M16/AR-15™-style family of rifles may include, among other suitable components, a barrel 16 (e.g., one or more elongate barrels), a hammer release 18, and a buffer tube 20, wherein the buffer tube 20 may be in-line with the barrel 16 and may extend proximal of the hammer release 18.

The firearm system 10 may include a sighting system 21, which may or may not be part of the firearm 12 and/or the stabilization system 14. In some examples, the sighting system 21, when included, may be mounted to or relative to the firearm 12 such that the sighting system 21 is configured to move with the firearm 12. In some examples, the sighting system 21 and/or components thereof may be in communication with a controller of the stabilization system 14.

The sighting system 21 may have any suitable configurations and/or components. For example, the sighting system 21 may be a passive optical device, a camera, a digital display, and/or other suitable components of sighting systems. In one example, the sighting system 21 may include a camera and a digital display. The sighting system 21 may be or may be part of an automatic aiming system.

The stabilization system 14 may have any suitable components. Example suitable components of the stabilization system 14 may include, but are not limited to, a housing 22, a pivot mount 24 (e.g., a gimbal), a motor assembly or system (not depicted in FIG. 1), a controller (not depicted in FIG. 1), a pistol grip 26 or other suitable hand grip, a lock 28 configured to lock a position of the firearm 12 relative to the housing 22 and allow the firearm 12 to move relative to the housing 22, a trigger 30, and/or other suitable components.

The housing 22 of the stabilization system 14 may include any suitable components configured to receive the firearm 12 and facilitating a user operating the firearm 12 while allowing the firearm 12 to adjust relative the housing 22 and the user. Example suitable components of the housing 22 include, but are not limited to, one or more buttstocks 32, one or more hand stocks 34, the pistol grip 26, one or more connectors 36 configured to couple the buttstock 32 and the hand stock 34, and/or other suitable components.

The buttstock 32 of the stabilization system 14 may have any suitable configuration. In some examples, the buttstock 32 may be located at a proximal end of the stabilization system 14, as depicted in FIG. 1, and may be configured to engage a user (e.g., a core, shoulder, chest, etc. of the user). The buttstock 32 may entirely or at least partially house the motor system of the stabilization system 14. In some examples, the buffer tube 20 may extend into and/or be received by the buttstock 32, as depicted for example in FIG. 1.

The hand stock 34 of the stabilization system 14 may have any suitable configuration. In some examples, the hand stock 34 may be located distal of the buttstock 32, such that the barrel 16 of the firearm 12 may extend through and/or may be received by the hand stock 34. In some examples, the hand stock 34 may be rigidly fixed (e.g., permanently fixed, locked in place if adjustable, etc.) relative to the buttstock 32. In operation, a user may grasp the hand stock 34 of the stabilization system 14 rather than the firearm 12 to facilitate adjustment of the firearm 12 relative to the housing 22 of the stabilization system 14 during use of the firearm 12. Other suitable configurations of the buttstock 32 are contemplated.

The hand stock 34 may be formed from one or more parts. In some examples, the hand stock 34 may be formed from a unitary component. In some examples, the hand stock 34 may be tubular, as depicted for example in FIG. 1, and in other examples, the hand stock 34 may have other suitable configurations including, but not limited to, an open top, etc. In another example, the hand stock 34 may include a slide component 38 and a stationary component 40. In some examples, the slide component 38 may be configured to slide relative to the stationary component 40. In one example, the slide component 38 may be part of the lock 28 or may be configured to actuate the lock 28. In one example, the slide component 38 may be a cover configured to adjustably cover a user interface (e.g., a control panel, etc.) and/or other suitable components of the stabilization system 14. Other suitable configurations of the hand stock 34 are contemplated.

The pistol grip 26 may have any suitable configuration and may be part of the housing 22 or may be separate from the housing 22. The pistol grip 26 may be located at any suitable location between a proximal end of the buttstock 32 and a distal end of the hand stock 34 that allows a user to grip the pistol grip 26 with a first hand while engaging the buttstock 32 with the user and holding the hand stock 34 with a second hand. In some examples, the pistol grip 26 may be located along the housing 22 at a location that corresponds to location of a pistol grip of the firearm 12 (e.g., where the pistol grip of the firearm 12 may be removed for insertion in the stabilization system 14). In some examples, the pistol grip 26 may be rigidly fixed (e.g., permanently fixed, locked in place if adjustable, etc.) relative to the buttstock 32 and/or the hand stock 34 such that the pistol grip 26 may move with the buttstock 32 and the hand stock 34 and the firearm 12 may be adjusted relative to the pistol grip 26. Other suitable configurations of the pistol grip 26 are contemplated.

The trigger 30 of the stabilization system 14 may be at any suitable location along the housing 22. In some examples, the trigger 30 may be distal of the pistol grip 26 and actuatable with a finger of a hand of user that is gripping the pistol grip 26. The trigger 30 may be adjustable (e.g., rotationally adjustable, linearly adjustable, pivotably adjustable, etc.) with respect to one more component of the housing 22 of the stabilization system 14 to fire the firearm 12. In one example, a bottom portion of the trigger 30 may be pivotably mounted with the housing 22 and a top portion of the trigger 30 may be configured to engage the hammer release 18 of the firearm 12, but other suitable configurations of the trigger 30 are contemplated.

In some examples, the trigger 30 may be configured to move with the housing 22 of the stabilization system 14 and the hammer release 18 may be configured to move with the firearm 12 and relative to trigger 30 and/or the housing 22. In some examples, the trigger 30 may be positioned relative to the hammer release 18 of the firearm 12 (e.g., positioned in contact with or spaced from the hammer release 18) and relative to the pistol grip 26 of the stabilization system 14, such that a user may fire the firearm 12 when gripping the pistol grip 26 of the stabilization system 14 and actuating (e.g., applying pressure to) the trigger 30 in a proximal direction to engage the hammer release 18 in a manner similar to how a user may fire the firearm 12 when the firearm 12 is not used with the stabilization system 14.

The pivot mount 24 may receive and/or may be configured to receive the firearm 12 and pivot (e.g., with or without the firearm 12) about one or more axes relative to the housing 22. In some examples, the pivot mount 24 may facilitate movement of the firearm 12 relative to the housing 22 such that the firearm has at least two-degrees of freedom relative to the housing 22. In some examples, the pivot mount 24 may be configured to pivot about a first axis 42 (e.g., an elevation axis or x-axis) and a second axis 44 (e.g., an azimuth axis or y-axis) generally perpendicular to the first axis 42, but other movement of the pivot mount 24 about other suitable axes and/or independent of an axis (e.g., a ball joint) is contemplated.

The pivot mount 24 may be located at any suitable location along the housing 22 configured to receive the firearm 12. In some examples, the pivot mount 24 may be located proximal of the trigger 30 of the stabilization system 14 and the hammer release 18 of the firearm 12. In some examples, the pivot mount 24 may be located along the housing 22 such that the buffer tube 20 extends through the pivot mount 24 and the pivot mount 24 is proximal of the sighting system 21. The sighting system 21 may be generally aligned with a location of an eye of a user who is aiming the stabilization system 21. Other suitable positions for the pivot mount 24 are contemplated.

In operation, when the firearm 12 is received within the stabilization system 14, the firearm 12 may be configured to rotate and/or pivot about the first axis 42 and the second axis 44. The stabilization system 14 may be configured to rotate and/or pivot the firearm 12 relative to the housing 22 to prevent or mitigate movement from a user holding the stabilization system 14 from transferring to the firearm 12.

Figures 2A, 2B:
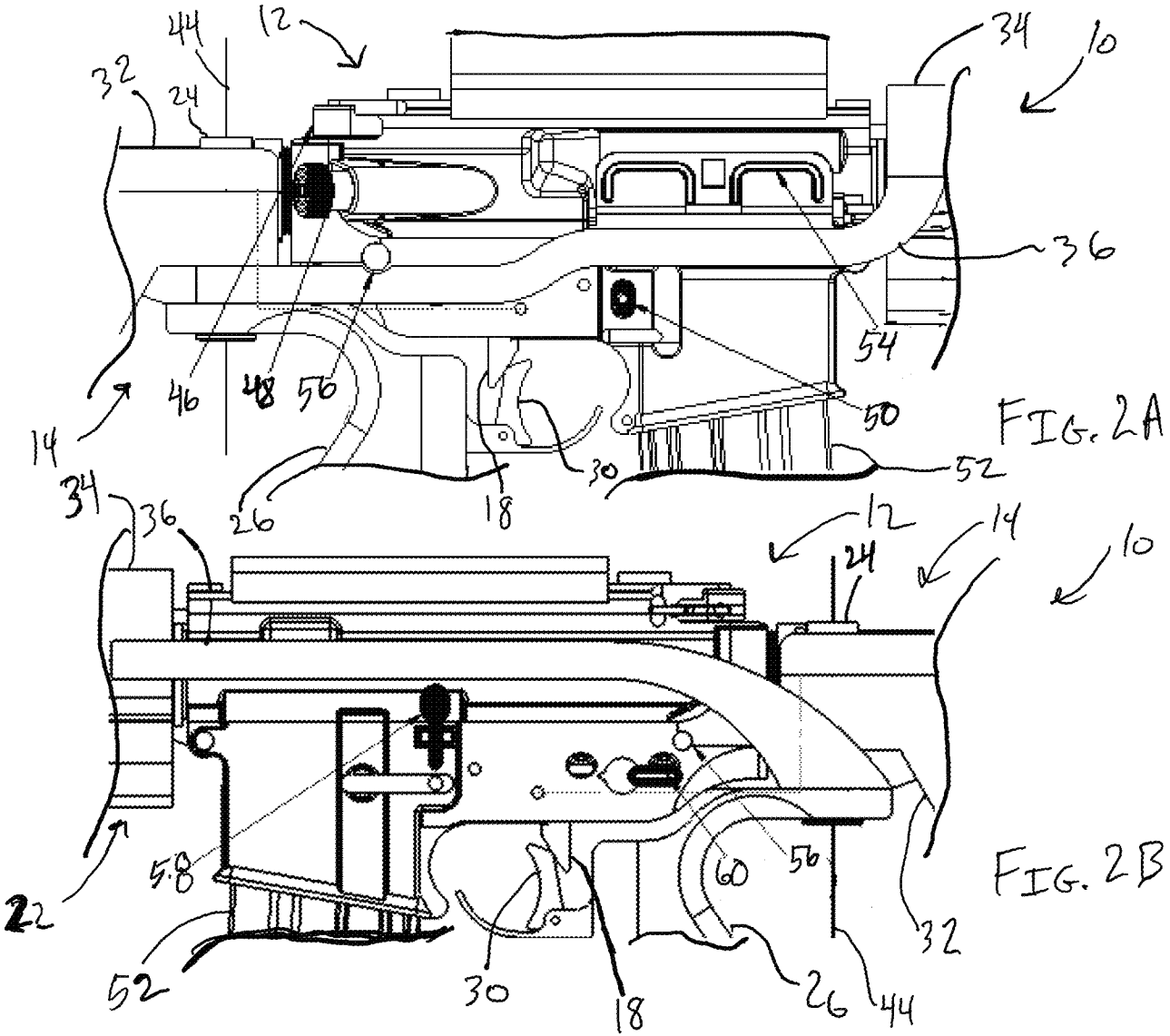
FIGS. 2A and 2B depict schematic opposing side views of a portion of the firearm system depicted in FIG. 1.

FIGS. 2A and 2B depict schematic side views of a portion of the illustrative configuration the firearm system 10 depicted in FIG. 1. In some examples, the housing 22 of the stabilization system 14 may allow and/or facilitate user access to standard components or controls of the firearm 12 received with the in the housing 22. FIG. 2A depicts a first side view of the firearm system 10 at a location between the buttstock 32 and the hand stock 34 of the stabilization system 14. FIG. 2B depicts a second side view of the firearm system 10 opposite the first side view and at the location between the buttstock 32 and the hand stock 34 of the stabilization system 14.

As discussed, the housing 22 may include one or more connectors 36 coupling the buttstock 32 and the hand stock 34. The connectors 36 may be rigidly fixed relative to the buttstock 32 and/or the hand stock 34 or pivotably mounted relative to the buttstock 32 and/or the hand stock 34. In some examples, the connectors 36 may be defined by openings in the housing between the buttstock 32 and the hand stock 34 providing user access to components of the firearm 12 in the stabilization system 14.

As depicted in FIGS. 2A and 2B, the housing 22 (e.g., the connectors 36 of the housing 22) may be configured to allow user access to features or components of the firearm 12 between the barrel 16 (not shown in FIGS. 2A and 2B) and the buffer tube 20 (not shown in FIGS. 2A and 2B). For example, the housing 22 may allow user access to one or more features or components of the firearm 12 including, but not limited to, a charging handle 46, a forward assist 48, a magazine release button 50 for releasing a magazine 52, an ejection port 54 for ejecting a shell, a breakdown pin 56, a bolt catch release 58, a safety 60, and/or access to other suitable features or components of the firearm 12. In some examples, the connectors 36 on each side of the housing 22 may have different configurations to allow for user access to different features or components of the firearm 12 received within the housing 22 or may have the same configurations. In some examples, the housing 22 may be open on top so that when the breakdown pin 56 has been retracted, an upper receiver (not shown in FIGS. 2A and 2B) of the firearm 12 may be able to tilt up and allow removal of the charging handle 46 and bolt carrier (not shown in FIGS. 2A and 2B) of the firearm 12 for standard cleaning and/or for other suitable purposes.

Figure 3:
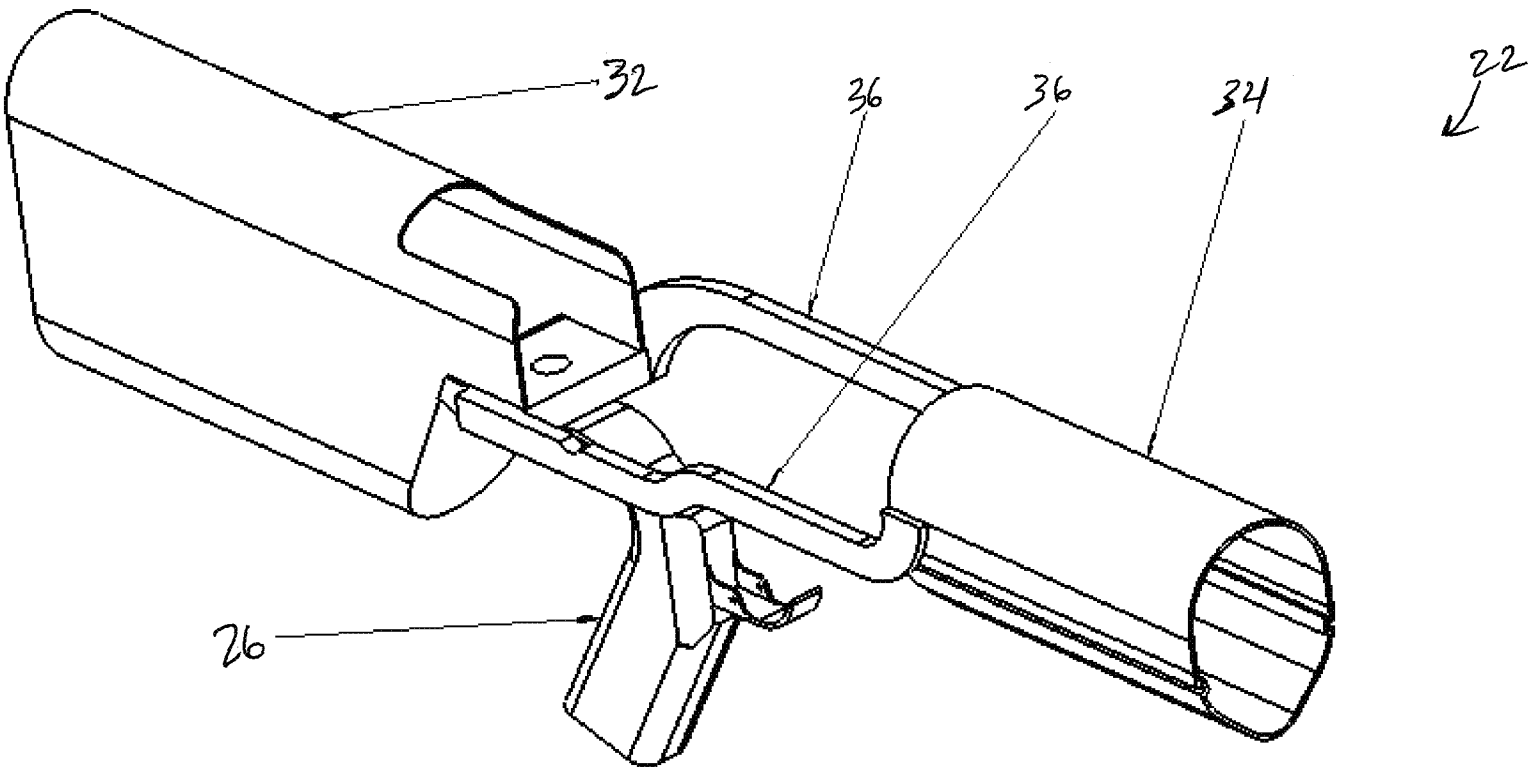
FIG. 3 depicts a schematic perspective view of an illustrative configuration of a housing of a stabilization system.

FIG. 3 depicts a schematic perspective view of an illustrative configuration of the housing 22 of the stabilization system 14. As depicted in FIG. 3 and discussed herein, the housing 22 may include, among other suitable features and/or components, the pistol grip 26 or other suitable grip for grasping with a trigger-pulling hand, the buttstock 32, the hand stock 34, and the one or more connectors 36 (e.g., two connectors, as depicted for example in FIG. 3). In some examples, the hand stock 34 may be a hollow, tubular structure configured to receive the barrel 16 and/or an action of the firearm 12 and/or other suitable structure configured to allow a user to securely hold the firearm system 10 without touching the firearm 12, as directly holding the firearm 12 may restrict movement of the firearm 12 by the stabilization system 14 relative to the housing 22. The buttstock 32 may be a hollow structure or other suitable structure configured to receive the buffer tube 20, a motor system, and/or other suitable components or features of the firearm system 10.

Figure 4B:
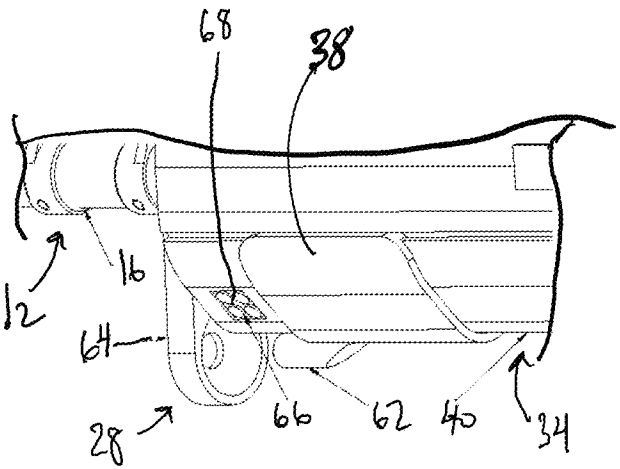
FIGS. 4A and 4B depict schematic side perspective views of an illustrative configuration of a lock for a stabilization system.
Figure 4A:
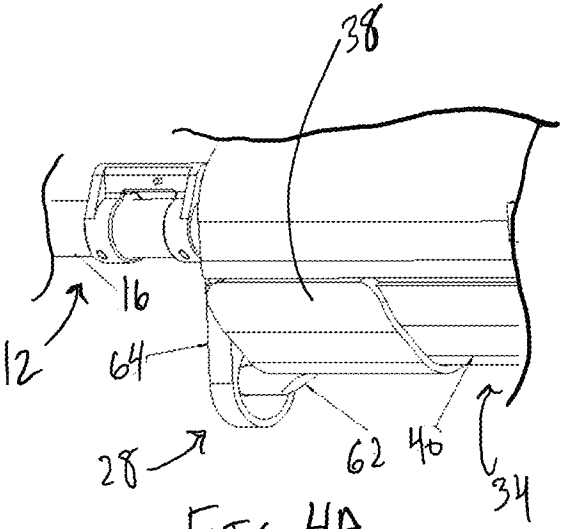

FIGS. 4A and 4B depict schematic side perspective views of a portion of the illustrative configuration of the firearm system 10 depicted in FIG. 1. FIG. 4A depicts a side perspective view of the lock 28 between the housing 22 and the firearm 12 in a first configuration (e.g., a locked configuration). FIG. 4B schematically depicts a side perspective view of the lock 28 between the housing 22 and the firearm 12 in a second configuration (e.g., in an unlocked configuration).

The lock 28 may have any suitable components. In one example, the lock 28 may include a first lock component 62 and a second lock component 64, where the first lock component 62 may engage the second lock component 64 to positionally lock the firearm 12 relative to the stabilization system 14. The lock 28 may be a mechanical lock, as depicted for example in FIGS. 4A and 4B, an electrical lock, a magnetic lock, and/or other suitable type of lock. Although other configurations are contemplated, the first lock component 62 may be a lock pin and the second lock component 64 may be a lock opening or recess configured to receive the lock pin. In some examples, one or both of the first lock component 62 and the second lock component 64 (e.g., as depicted in FIG. 4B) may include a tapered surface configured to direct the lock pin toward the lock opening or recess.

As schematically depicted in FIG. 4A, the first lock component 62 (e.g., a male component) may be inserted into or through the second lock component 64 (e.g., a female component) when the lock 28 is in the first configuration. In some examples, the first lock component 62 may be coupled (e.g., rigidly fixed) with the slide component 38 configured to adjust relative to the stationary component 40. In some examples, the second lock component 64 may be secured to the barrel 16 of the firearm 12 such that the first lock component 62 may adjust relative to the second lock component to adjust the lock 28 between the first configuration of the lock 28 and the second configuration of the lock 28.

FIG. 4B schematically depicts the slide component 38 adjusted to disengage the first lock component 62 from the second lock component 64. In some examples, the slide component 38 may be configured to cover a control panel 66 when the lock 28 is in the first configuration and uncover the control panel 66 when the lock 28 is in the second configuration. Allowing for adjustment of the lock 28 between the first configuration and the second configuration by adjusting the slide component 38 at the hand stock 34 may facilitate adjusting the lock 28 by the user without significant adjustment of a shooting position of the user.

The control panel 66 may include one or more user selectable buttons 68 (not all buttons 68 are labeled for clarity purposes). The selectable buttons 68 may be physical buttons and/or virtual buttons. In some examples, the selectable buttons 68 may be selected by user to select a mode of operation for the stabilization system 14, to adjust or select a gain for one or more components of the stabilization system 14, and/or to select one or more other suitable options or to provide other user input for operating the stabilization system 14.

Figure 5:
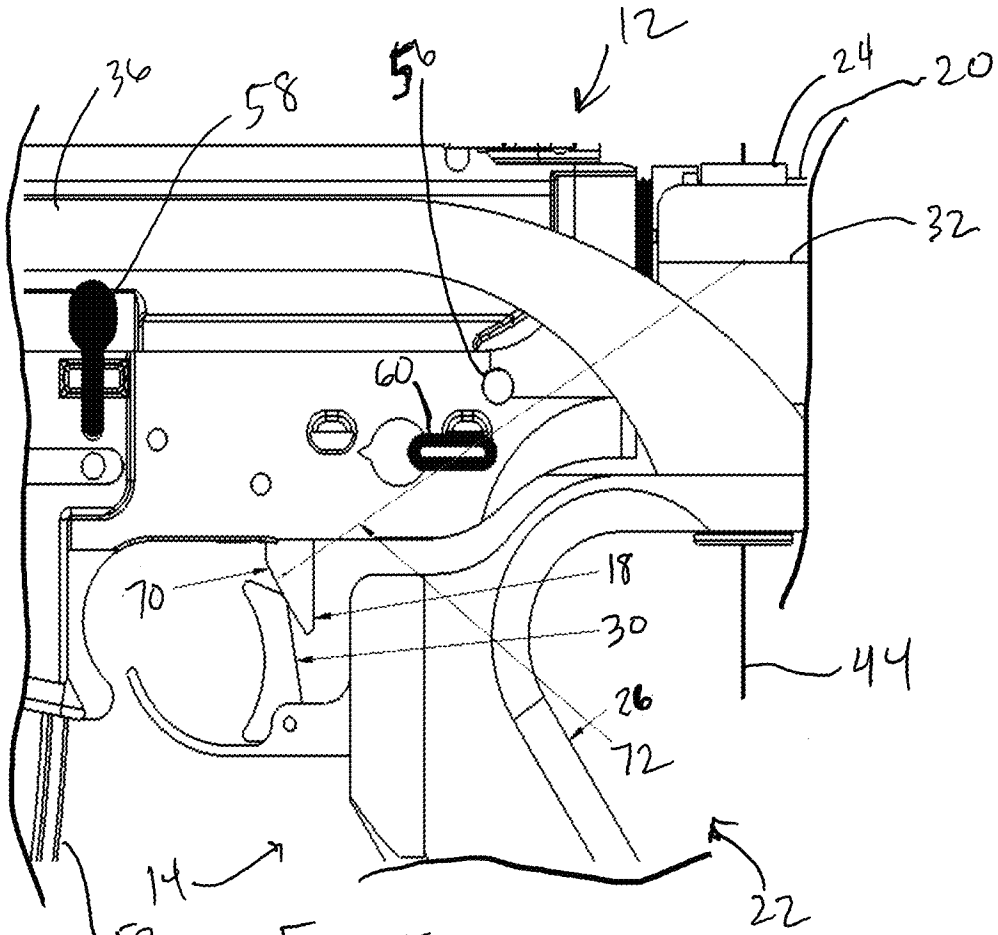
FIG. 5 depicts a schematic side view of a portion of the firearm system depicted in FIG. 1.

FIG. 5 schematically depicts a side view of a portion of the firearm system 10 depicted in FIG. 1. As depicted in FIG. 5, the trigger 30 may be pivotably connected to and/or coupled with the housing 22. As discussed, the firearm 12 may include the hammer release 18 (e.g., an internal hammer release) that may be in contact with the trigger 30 when in a resting or non-actuated position or configuration. As such, pressure applied by a user on the trigger 30 may be transmitted to the hammer release 18 through a sliding contact patch. As the trigger 30 may move with the housing and the hammer release 18 may move with the firearm 12 as the stabilization system 14 adjusts the firearm 12 relative to the housing 22, movement of the firearm 12 relative to the housing 22 will not produce movement of the trigger 30 that disturbs a user's trigger control (e.g., a positioning of the trigger 30).

The hammer release 18 may have any suitable configuration. In some examples, the hammer release 18 may include a surface 70 (e.g., a trigger contact surface) that is planar, round, spherical, and/or that may have one or more other suitable configurations. In one example, the surface 70 of the hammer release 18 may be a spherical surface with a center of curvature at a firearm rotation point with a radius shown as a line labeled 72. With the surface 70 having a spherical configuration and a center of curvature at the rotation point of the firearm 12, the forces between the trigger 30 and the hammer release 18 may act on a line through the center of rotation and avoid producing a torque about the center of rotation. Torque about the center of firearm rotation may destabilize the firearm 12 and thus, may be mitigated through use of the hammer release 18 having the surface 70 with a spherical configuration.

Figure 6:
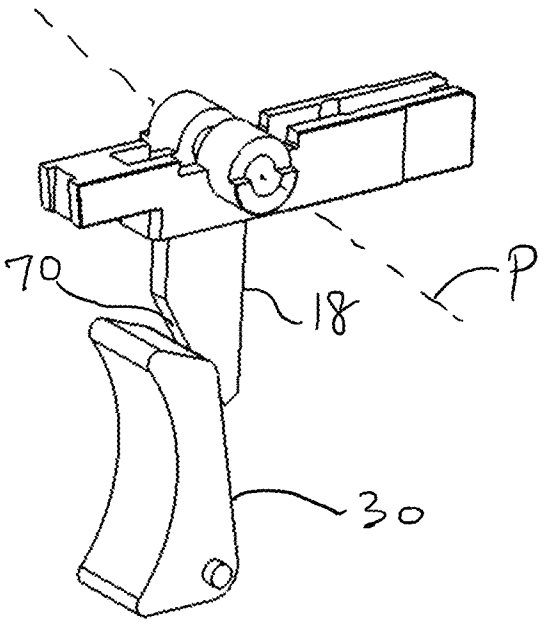
FIG. 6 depicts a schematic perspective view of an illustrative configuration of a trigger and a hammer release.

FIG. 6 schematically depicts a detailed perspective view of the trigger 30 and the hammer release 18. As depicted in FIG. 6, the hammer release 18 may be configured to pivot about a pivot axis P in response to being actuated by the trigger 30. In some examples, the trigger 30 may have a surface for contacting the hammer release 18 that is wider than a width of the surface 70, as depicted for example in FIG. 6, which may facilitate the trigger engaging the hammer release 18 as the hammer release 18 is adjusted with the firearm 12 relative to the housing 22.

Figure 7:
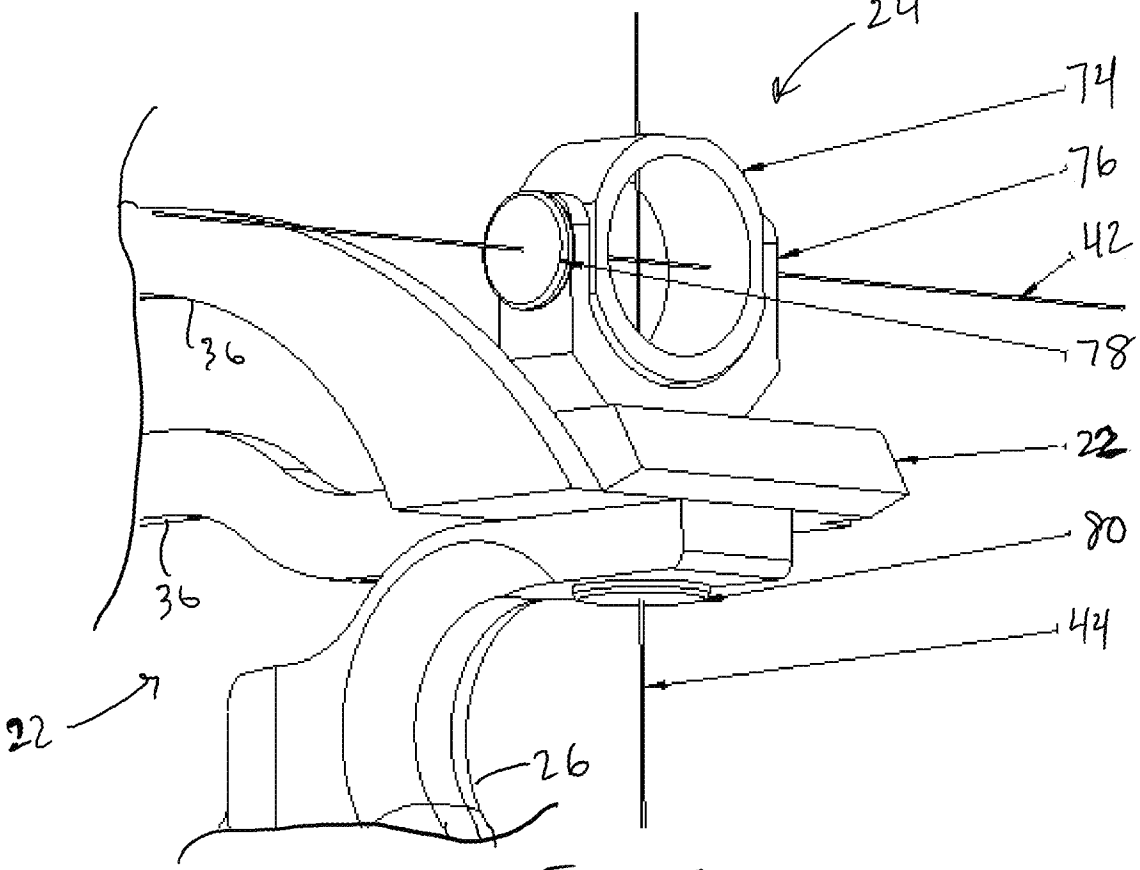
FIG. 7 depicts a schematic perspective view of a portion of an illustrative configuration of a stabilization system.

FIG. 7 schematically depicts an illustrative configuration of the pivot mount 24 relative to the housing 22, with the buttstock 32 removed for clarity. The pivot mount 24 may include any suitable components. In some examples, the pivot mount 24 may include a first component 74 configured to receive the buffer tube 20 of the firearm 12 and a second component 76 configured to mount the first component 74 to the housing 22. The first component 74 of the pivot mount 24 may be any suitable type of component including, but not limited to, a ring or other suitable component configured to receive the buffer tube 20. The second component 76 may be any suitable type of component including, but not limited to a yoke or other suitable component configured to receive and/or engage the first component 74. In some examples, the second component 76 may be configured to receive the first component 74 in a manner that allows the first component 74 to pivot about the first axis 42. In some examples, the second component 76 may be configured to mount to the housing 22 in a manner that allows the first component 74 and the second component to pivot about the second axis 44. Other suitable configurations of the pivot mount 24 are contemplated.

The stabilization system 14 may include one or more sensors to sense relative movement of the pivot mount 24 and thus, relative movement of the firearm 12 extending through the pivot mount 24. In some examples, one or more first sensors 78 (e.g., potentiometers, encoders, etc.) may be configured to measure or sense a rotational angle of the first component 74 relative to the second component 76 about the first axis 42. In some examples, one or more second sensors 80 (e.g., potentiometer, encoder, etc.) may be configured to measure or sense a rotational angle of the second component 76 (and thus the first component 74) relative to the housing 22. Outputs of the first sensor 78 and the second sensor 80 may be output to a controller of the stabilization system 14. Other suitable sensors and/or sensor configurations for sensing a position of the firearm 12 are contemplated.

The first sensor 78 and/or the second sensor 80 may be any suitable types of sensors. In some examples, the first sensor 78 and/or the second sensor 80 may be potentiometers, encoders, RVDTs and/or other suitable sensor configurations. In one example, the first sensor 78 and/or the second sensor 80 may be configured to sense movements that are difficult for humans to detect (e.g., changes in rotation and/or orientation).

Figure 8:
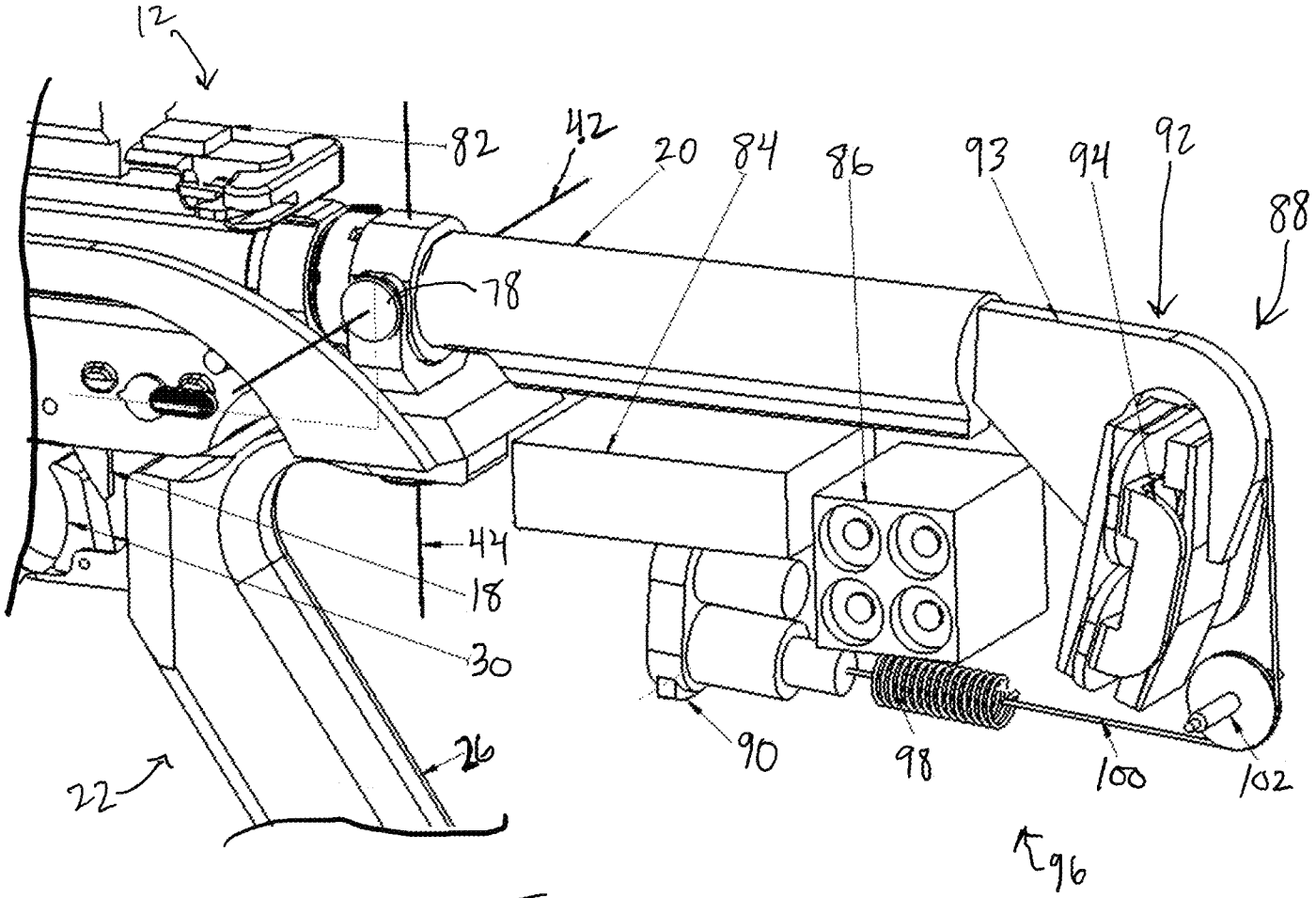
FIG. 8 depicts a schematic perspective view of a portion of the illustrative firearm system of FIG. 1, with a portion of a housing removed.

FIG. 8 schematically depicts a perspective view of a portion of the firearm system 10, with the buttstock 32 removed to depict components of the firearm system 10 within the buttstock 32. The stabilization system 14 may include or be in communication with a gyroscope package 82 containing a minimum of two space rate sensors oriented to sense rotation in space about the first axis 42 and the second axis 44. In some examples, the gyroscope package 82 may be coupled with the firearm 12 and configured to move with the firearm 12. The gyroscope package 82 may be configured to sense movements of the firearm 12 that are difficult for humans to detect (e.g., changes in rotation and/or orientation). The space rate sensors of the gyroscope package 82 may be rate gyros, rate integrating gyros, and/or any of a variety of commercially available MEMS gyros. The gyroscope package 82 may be an inertial measurement unit (IMU) package that includes at least two rate sensors.

The stabilization system 14 may include, among other components, a controller 84 (e.g., an electronics package or part of an electronics package), a power source 86, a motor system 88, and a linear actuator 90. In some examples, the controller 84, the power source 86, and the motor system 88 may be housed and/or coupled with the housing 22. The controller 84 may be in communication with the sighting system 21, the control panel 66, the first sensor 78, the second sensor 80, the gyroscope package 82, the power source 86, the motor system 88, the linear actuator 90 and/or other suitable electronic components so as to receive data from and/or output control signals to these components for adjusting and/or otherwise controlling a position of the firearm 12 relative to the housing 22.

The power source 86 may be any suitable type of power source 86. The power source 86 may comprise one or more batteries, one or more replaceable batteries, one or more rechargeable batters, one or more plugs for connecting with a further power source, and/or may include one or more other suitable features facilitating providing power to the firearm system 10.

The motor system 88 may have any suitable configuration. In some examples, the motor system 88 may be coupled with the buffer tube 20 and configured to adjust the barrel 16 of the firearm 12 relative to the housing 22. In some examples, the motor system 88 may include one or more motors configured to adjust the barrel 16 of the firearm 12 relative to the housing 22. In one example, the motor system 88 may include a field assembly 92 coupled to the buffer tube 20 (e.g., coupled with a proximal end of the buffer tube 20 or other suitable portion of the buffer tube 20 proximal of the pivot mount 24 with a connector 93 of the field assembly 92) and a coil assembly 94 coupled with the buttstock 32. Magnetic interaction between the field assembly 92 and the coil assembly 94 may produce torques on the firearm 12 about the first axis 42 and the second axis 44. Other suitable systems for producing torque about the first axis 42 ad the second axis 44 that may be used in the firearm system 10 include, but are not limited to, individual voice coil motors, geared conventional motors, and/or other suitable torque producing systems.

The linear actuator 90 may be part of or separate from an imbalance counter-torque system 96 configured to maintain a desired balance torque on the firearm 12 about the first axis 42. In some examples, the imbalance counter-torque system 96 may include the linear actuator 90, a spring 98, a cable 100, a pulley 102, and/or other suitable components. In some examples, the pulley 102 may be pivotably mounted on the housing 22. The cable 100 may include a first end coupled with a first end of the spring 98 and a second end coupled with the field assembly 92. The spring 98 may include a second end coupled with the linear actuator 90 such that the linear actuator 90 may be configured to actuate (e.g., stretch) the spring 98 in response to control signals from the controller 84. The cable 100 may be flexible and capable of stretching around the pulley 102 in response to actuation of the spring 98. As such, tension on the cable 100 may produce torque around the first axis 42 between the firearm 12 and the housing 22

A center of gravity of the firearm 12 may be forward of the first axis 42 at the pivot mount 24. As such, when the firearm 12 is held horizontally, there will be a continuous torque causing the front of (e.g., the barrel 16 of) the firearm 12 to rotate downward. This constant imbalance-torque may be counter balanced by tension provided by the cable 100 of the imbalance counter-torque system 96 while allowing relatively free movement (e.g., rotation) of the firearm 12 relative to the housing 22 about the first axis 42 due to extension and contraction of a length of the spring 98. The linear actuator 90 may allow for tension in the flexible cable to be adjusted (e.g., in real time) as the firearm 12 imbalance changes over time, where imbalance changing over time would happen if the firearm 12 were being fired and the weight of the ammunition magazine were dropping, for example. The imbalance may also change if the barrel 16 is elevated and the firearm 12 is aimed at an angle relative to gravity. The controller 84 and/or the imbalance counter-torque system 96 (e.g., an electronics package including the controller 84 and/or the imbalance counter-torque system 96) may contain an inclinometer to sense this angle and adjust the linear actuator 90 appropriately.

Figure 9:
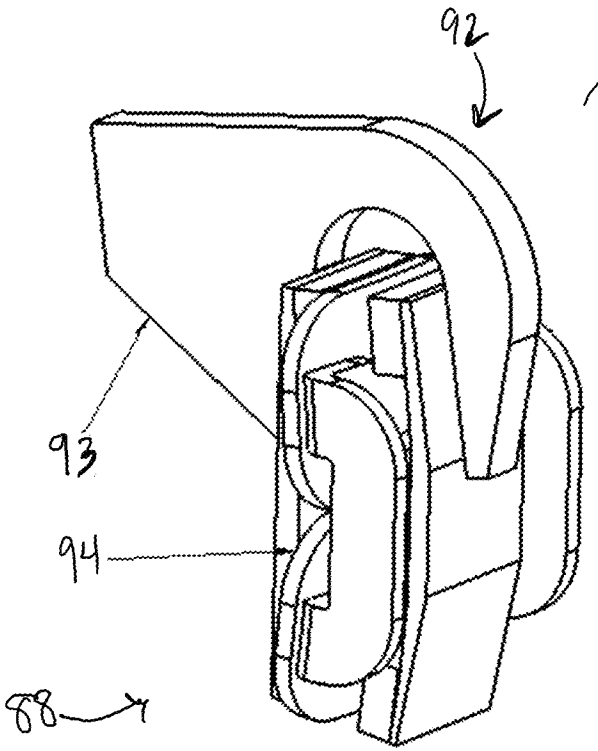
FIG. 9 depicts a schematic perspective view of an illustrative motor system of a stabilization system.

FIG. 9 schematically depicts a perspective detailed view of the motor system 88. The motor system 88 may include the field assembly 92 with the connector 93 and the coil assembly 94, where the coil assembly 94 may be inserted into the field assembly 92, as depicted in FIG. 9.

Figure 10:
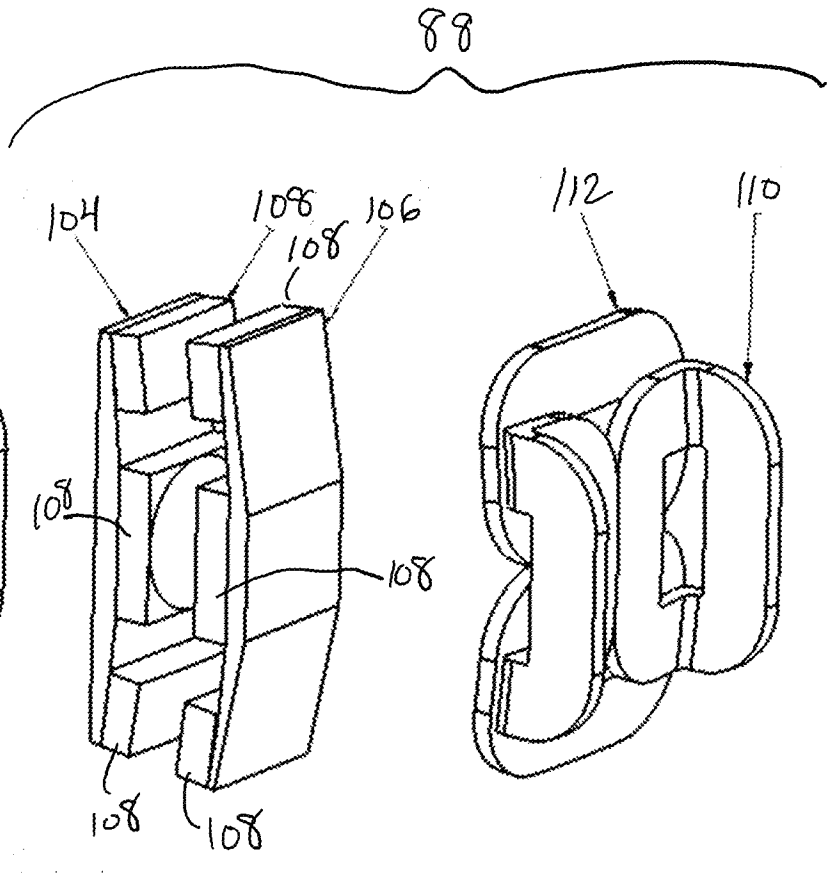
FIG. 10 depicts a schematic exploded view of a portion of the motor system depicted in FIG. 9.

FIG. 10 schematically depicts a partial exploded view of the field assembly 92 and the coil assembly 94 separated from one another. In some examples, the field assembly 92 may include one or more front back irons 104, one or more rear back irons 106, and a plurality of magnets 108, where the plurality of the magnets 108 may be coupled with and/or supported by the front back iron 104 and a plurality of magnets 108 may be coupled with and/or supported by the rear back iron 106. In some examples, the coil assembly 94 may include one or more first set of coils 110 (e.g., a coil pair or an azimuth coil pair configured to adjust the firearm 12 about the second axis 44 when actuated) and one or more second sets of coils 112 (e.g., a second coil pair or an elevation coil pair configured to adjust the firearm 12 about the first axis 42 when actuated).

In operation when the controller 84 may cause electrical currents to pass through the second set of coils 112, the second set of coils 112 may interact with the magnets 108 to produce a force that results in torque being applied to the firearm 12 about the first axis 42. When the controller 84 causes electrical currents to pass through the first set of coils 110, the first set of coils 110 may interact with the magnets 108 to produce a force that results in torque being applied to the fire arm about the second axis 44. A magnitude and direction of the forces produced may depend on a magnitude and direction of the current applied to the first set of coils 110 and/or the second set of coils 112. Although a magnetic and coil configuration of the motor system 88 has been described, other suitable configurations of the motor system 88 are contemplated.

Figure 11:
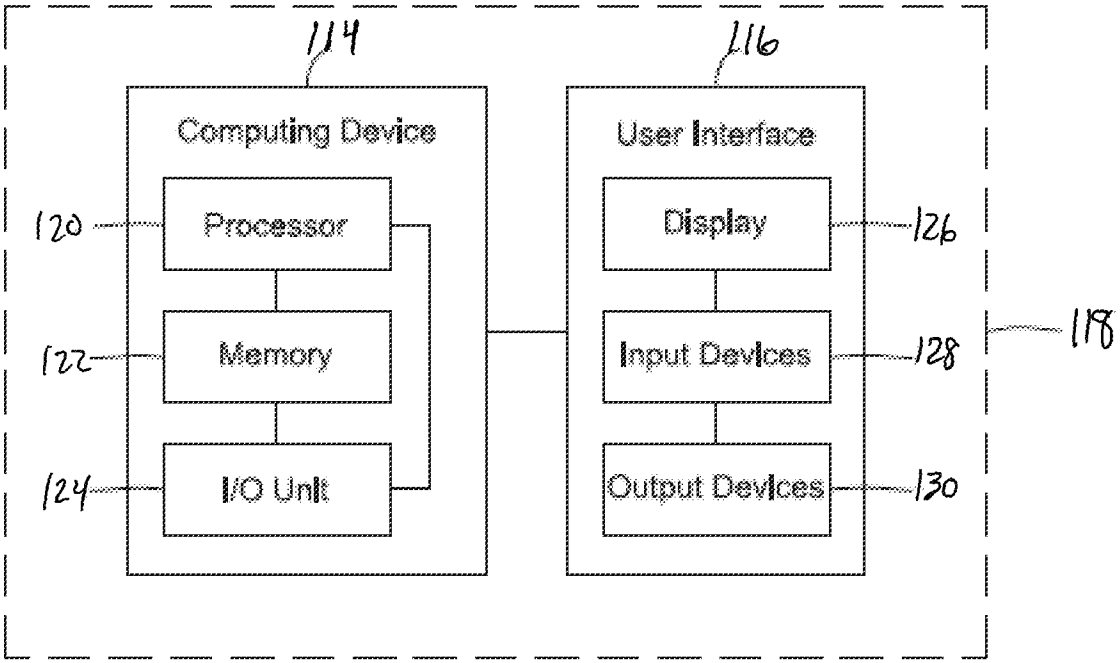
FIG. 11 depicts a schematic diagram of an illustrative computing device and user interface.

The controller 84 and/or other components of the firearm system 10 may be or may include one or more computing devices including or coupled with one or more user interfaces. FIG. 11 depicts a schematic diagram of an illustrative computing device 114 and a user interface 116, where the computing device 114 and/or the user interface 116 may be entirely or partially housed in one or more housings 118 (e.g., a housing which may or may not house other components of the firearm system 10, the housing 22, and/or other suitable housing). The housing 118 may be an optional component, as represented by the broken lines defining the housing 118 depicted in FIG. 11. Although various components are depicted as being included in the computing device 114 and the user interface 116, one more of the depicted components may be omitted and/or one or more additional or alternative components may be utilized.

The computing device 114 may be any suitable computing device configured to process data of or for the firearm system 10 (e.g., for the stabilization system 14) and may be configured to facilitate operation of the firearm system 10. The computing device 114, in some cases, may be configured to control operation of the firearm system 10 by establishing and/or outputting control signals to the components of the stabilization system 14 and/or the sighting system 21 to stabilize, adjust, and/or facilitate stabilizing and/or adjusting the firearm 12 relative to the housing 22. In some examples, the computing device 114 may be part of the controller 84 and may communicate with other components over an optical, wired or wireless connection, but other suitable configurations are contemplated. When the computing device 114, or at least a part of the computing device 114, is a component separate from a structure of the controller 84, the computing device 114 may communicate with electronic components of the firearm system 10 over one or more optical, wired, or wireless connections or networks (e.g., LANs and/or WANs). In some cases, the computing device 114 may communicate with a remote server or other suitable computing device.

The illustrative computing device 114 may include, among other suitable components, one or more processors 120, memory 122, and/or one or more input/output (I/O) units 124. Example other suitable components of the computing device 114 that are not specifically depicted in FIG. 11 may include, but are not limited to, communication components, a touch screen, selectable buttons, and/or other suitable components of a computing device. As discussed, one or more components of the computing device 114 may be separate from the controller 84 or other electronics of the firearm system 10 and/or incorporated into the components of the controller 84 or other electronics of the firearm system 10. In some examples, the controller 84 or other electronics of the firearm system 10 may include one or more processors 120 and memory 122 in communication with the processor (s) 120, wherein the memory 122 may include instructions executable by the processor(s) 120 to cause the processor(s) 120 to perform one or more of the methods, control operations, loops, and/or techniques described herein.

The processor 120 of the computing device 114 may include a single processor or more than one processor working individually or with one another. The processor 120 may be configured to receive and execute instructions, including instructions that may be loaded into the memory 122 and/or other suitable memory. Example components of the processor 120 may include, but are not limited to, central processing units, microprocessors, microcontrollers, multicore processors, graphical processing units, digital signal processors, application specific integrated circuits (ASICs), artificial intelligence accelerators, field programmable gate arrays (FPGAs), discrete circuitry, and/or other suitable types of data processing devices.

The memory 122 of the computing device 114 may include a single memory component or more than one memory component each working individually or with one another. Example types of memory 122 may include random access memory (RAM), EEPROM, flash, suitable volatile storage devices, suitable non-volatile storage devices, persistent memory (e.g., read only memory (ROM), hard drive, flash memory, optical disc memory, and/or other suitable persistent memory) and/or other suitable types of memory. The memory 122 may be or may include a transitory or a non-transitory computer readable medium. The memory 122 may include instructions stored in a transitory state and/or a non-transitory state on a computer readable medium that may be executable by the processor 120 to cause the processor 120 to perform one or more of the methods, control operations, loops, and/or techniques described herein. Further, in some cases, the memory 120 and/or other suitable memory may store data received from the sighting system 21, a distancing component, the first sensor 78, the second sensor 80, the gyroscope package 82, and/or other electronic components of or in communication with the firearm system 10.

The I/O units 124 of the computing device 114 may include a single I/O component or more than one I/O component each working individually or with one another. Example I/O units 124 may be or may include any suitable types of control lines (e.g., discrete digital, logic, or analog), communication hardware, and/or software including, but not limited to, communication components or ports configured to communicate with electronic components of the firearm system 10 and/or with other suitable computing devices or systems. Example types of I/O units 124 may include, but are not limited to, wired communication components (e.g., HDMI components, Ethernet components, VGA components, serial communication components, parallel communication components, component video ports, S-video components, composite audio/video components, DVI components, USB components, optical communication components, and/or other suitable wired communication components), wireless communication components (e.g., radio frequency (RF) components, Low-Energy BLUETOOTH protocol components, BLUETOOTH protocol components, Near-Field Communication (NFC) protocol components, WI-FI protocol components, optical communication components, ZIGBEE protocol components, and/or other suitable wireless communication components), and/or other suitable I/O units 124.

The user interface 116 may be configured to communicate with the computing device 114 via one or more wired or wireless connections. The user interface 114 may include, among other components, one or more display devices 126, one or more input devices 128, one or more output devices 130, and/or one or more other suitable features. Although not depicted, the user interface 116 may include one or more indicators (e.g., light emitting diodes (LEDs), LED linear arrays, numbers, etc.) In some examples, the user interface 116 may be part of or may include the computing device 114. Alternatively or additionally, the user interface 116 may be part of a mobile device or remote computing system.

The display 126 may be any suitable display. Example suitable displays include, but are not limited to, touch screen displays, non-touch screen displays, liquid crystal display (LCD) screens, LED displays, head mounted displays, virtual reality displays, augmented reality displays, a mobile device display, and/or other suitable display types. In some examples, the display 126 may be configured to depict an image captured by the sighting system 21. The image may be a live image and/or a photograph or image captured at a previous time. In one example, the image may be a live image of a field of view captured by the sighting system 21. Further, the display 126 may display material other than the image including, but not limited to, one or more instructions (e.g., to fire, etc.), a target image, a directional symbol, a system status, results of an analysis of received or sensed data, marketing indicia, brand indicia, videos, user pictures, art work, etc.

The input device(s) 128 may be and/or may include any suitable components and/or features for receiving user input via the user interface 114. Example input device(s) 128 may include, but are not limited to, the buttons 68, touch screens, keypads, mice, touch pads, microphones, selectable buttons, selectable knobs, optical inputs, cameras, gesture sensors, eye trackers, voice recognition controls (e.g., microphones coupled to appropriate natural language processing components) and/or other suitable input devices. In one example, the input devices 128 may include a touch screen and/or the buttons 68 that allows for setting set points, initiating a mode of operation, adjusting between screens, and/or allows for taking one or more other suitable actions.

The output device(s) 130 may be and/or may include any suitable components and/or features for providing information and/or data to users and/or other computing components. Example output device(s) 130 include, but are not limited to, displays, speakers, headphones, vibration systems, tactile feedback systems, optical outputs, and/or other suitable output devices.

FIGS. 12-15 schematically depict electrical control configurations to control operation of the stabilization system 14. Although the description discusses adjustment of the firearm 12 about the second axis 44, the electrical control systems may be utilized in a similar manner to adjust the firearm 12 about the first axis 42.

Figure 12:
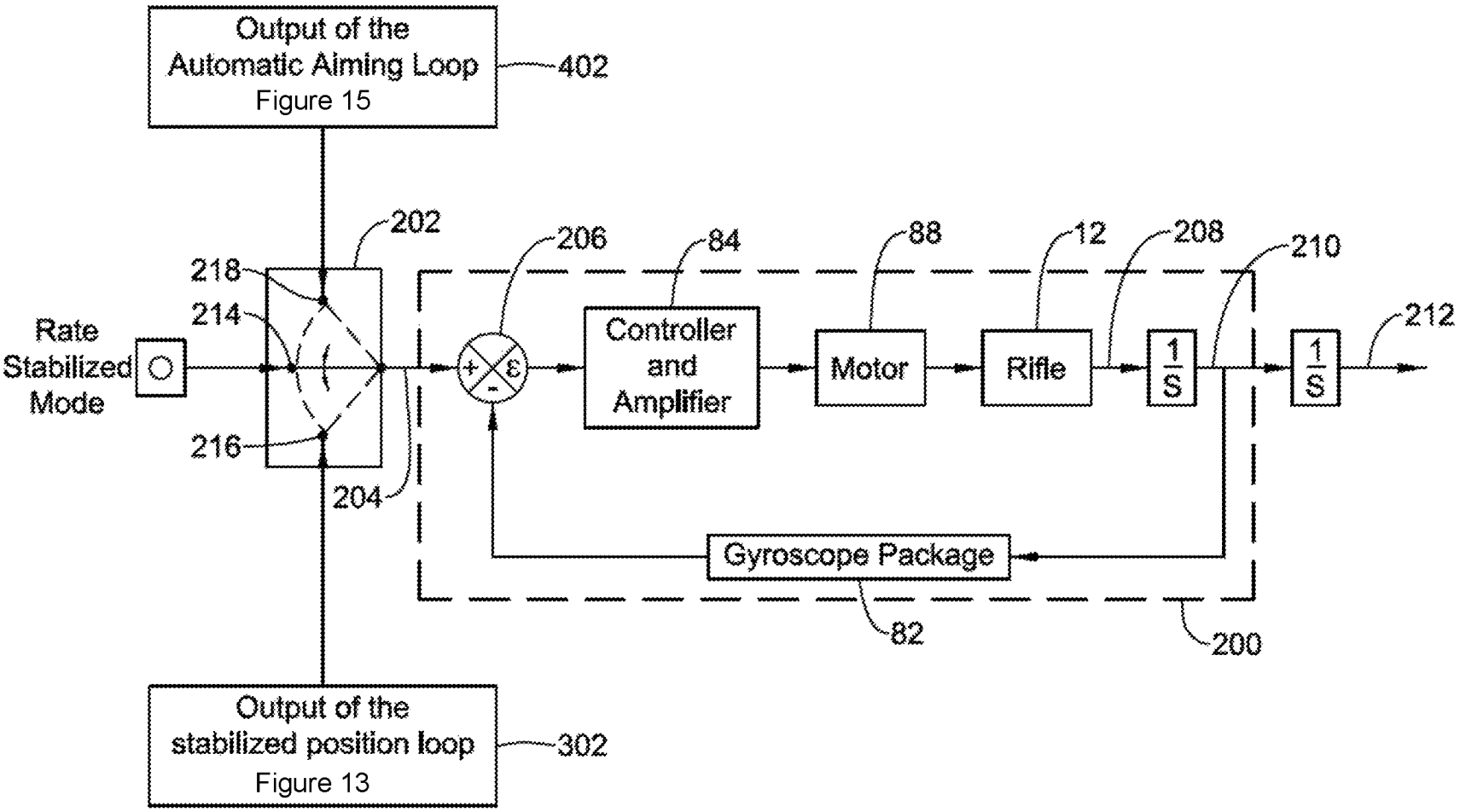
FIG. 12 depicts a schematic diagram of an illustrative control configuration.

FIG. 12 schematically depicts an illustrative configuration of a stabilized rate loop 200 (e.g., a control loop or operations) configured to receive an input from a mode switch 202. In some examples, the stabilized rate loop 200 depicted in FIG. 12 may be an inner-most servo loop (e.g., a rate loop). The mode switch 202 may be implemented in the stabilization system 14 via the buttons 68 and/or other suitable user input features of the stabilization system 14.

Mode switch 202 may be actuated by a user to select and/or switch (e.g., via a user selection) a mode of operation for the stabilization system 14. The stabilization system 14 may be configured to operate in one or more modes. When the stabilization system 14 includes a plurality of modes, the modes switch 202 may be actuated by a user to select a desired mode in which to operate the stabilization system 14.

The stabilization system 14 may be configured to operate in any suitable mode. Example suitable modes for operation the stabilization system 14 include, but are not limited to, a rate stabilization mode 214, a stabilized position mode 216, an automatic aiming mode 218, and/or other suitable modes. In one example, when the stabilization system 14 is configured to operate in the rate stabilization mode 214, the controller 84 may be configured to output control signals to the motor system 88 to automatically maintain the barrel 16 of the firearm 12 in a target position (e.g., a stabilized position in space) as the housing 22 moves. In one example, when the stabilization system 14 is configured to operate in the stabilized position mode 216, the controller 84 may be configured to output control signals to the motor system 88 to automatically move the barrel 16 of the firearm 12 in a direction of movement of the housing 22. In one example, when the stabilization system 14 is configured to operate in the automatic aiming mode 218, the controller 84 may be configured to output control signals to the motor system 88 to automatically move the barrel 16 of the firearm 12 with movement of a target. Additionally or alternatively, when in the automatic aiming mode 218, the controller 84 may be configured to output a control signal to the user interface 116 to cause (e.g., to initiate) a directional indicator to be presented to a user, where the directional indicator may indicate a direction the user should adjust the housing 22 to keep the housing 22 aligned with the barrel 16 of the firearm 12. Other suitable modes of operation for the stabilization system 14 are contemplated. A user may switch from one mode to another during operation of the firearm system 10 for different purposes while shooting at and/or tracking one or more targets.

As depicted in FIG. 12, the mode switch 202 may be adjusted to select one of the rate stabilized mode 214, the stabilized position mode 216, and the automatic aiming mode 218. A user has selected to operate the stabilization system 14 in the rate stabilized mode 214, as depicted in FIG. 12, and as such, the input rate command 204 may be set to zero so the angle of the firearm 12 in space may be constant. In some examples, a user may select the rate stabilized mode 214 when the firearm 12 is pointed at a desired target and the user desires the firearm 12 to remain as stable as possible during fully- or semi-automatic fire and/or if the user wants to closely observe a stationary target with the sighting system 21. The rate stabilized mode 214 may be selected for other purposes as desired. When the stabilized position mode 216 is selected the mode switch may receive an output 302 from a stabilized position loop 300 (see FIG. 13) and when the automatic aiming mode 218 is selected, the mode switch 202 may receive an output 402 from an automatic aiming loop 400 (see FIG. 15).

In operation, the loop 200 may accept an output from the mode switch 202 (e.g., a user input) as a rate command 204. The rate command 204 may be summed with an output of the gyroscope package 82 at a summing component 206.

The output of the summing component 206 may be processed by the controller 84 and amplified, as needed, with an amplifier to determine a control signal to be provided to the motor system 88. The controller 84 may output the control signal to the motor system 88. In some examples, the outputted control signal may be one or more currents having a magnitude and direction. In some examples, the motor system 88 may generate a torque on the firearm 12 in response to the motor system 88 receiving the control signal, which may result in angular acceleration 208 (e.g., positional adjustment) of the firearm 12 in space. The acceleration 208 of the firearm 12 will be integrated by nature into angular velocity 210 of the firearm 12 in space. The velocity 210 of the firearm 12 will be integrated by nature into an angle 212 of the firearm 12 in space. As a result, the angle 212 of the firearm 12 in space, will be controlled by a time history of the rate command 204. The gyroscope package 82 and/or other sensors (e.g., the first sensor 78, the second sensor 80, etc.) may sense a position and/or velocity of the firearm 12 and input the data to the controller 84.

When a user of the firearm system 10 wants to point the firearm 12 at a desired target, the user may have two options. A first option may be to lock the firearm 12 relative to the housing 22 and a second option may be to select the stabilized position mode 216.

When the user opts to lock the firearm 12 relative to the housing 22, the user may engage the first lock component 62 with the second lock component 64. In some examples, engaging the first lock component 62 with the second lock component 64 to position the lock 28 in the locked configuration may automatically de-energize the firearm 12 adjustment electronics of the stabilization system 14 and allow the user to handle the firearm system 10 as a conventional non-stabilized firearm 12. A downside of this option is that unintended movements of the user may cause unintended movement of the firearm 12, which may make it difficult to hit the target.

When the user opts to operate the stabilization system 14 in the stabilized position mode 216, the user may point the housing 22 toward the target and the firearm 12 may be electrically and/or automatically driven to the follow the housing 22. The user may then observe any misalignment between the firearm 12 and the target using the sighting system 21 (e.g., a conventional scope, a camera/display combo, etc.) and make continuous adjustments over time. The stabilized position mode 216 may be similar to a non-stabilized mode (e.g., when the lock 28 is in the lock configuration), except unintended movement of the firearm 12 due to movements of the user may be mitigated, which may increase a likelihood of a user hitting a desired target.

Figure 13:
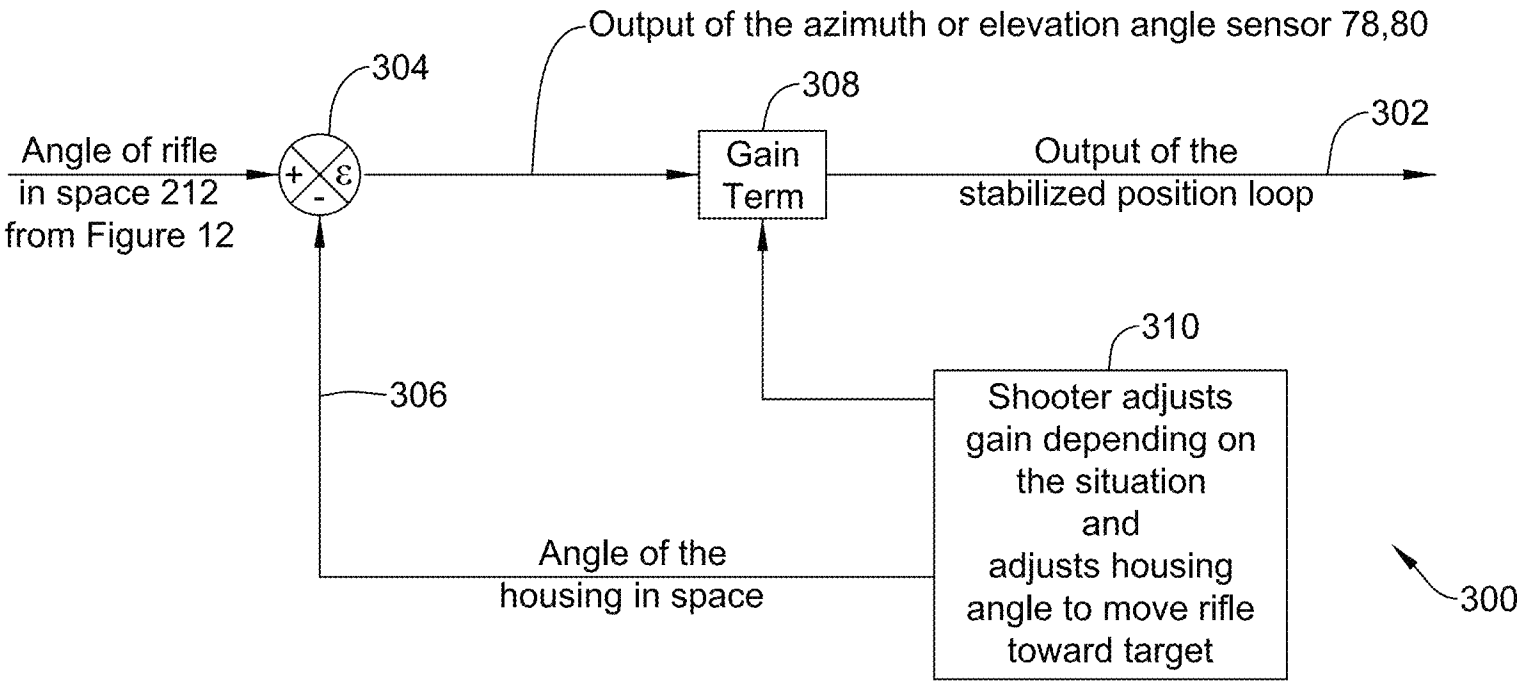
FIG. 13 depicts a schematic diagram of an illustrative control configuration.

FIG. 13 schematically depicts an illustrative configuration a stabilized position loop 300 (e.g., a control loop or operations). In the stabilized position loop 300, the angle 212 of the firearm 12 in space that is output from the stabilized rate loop 200 is summed with an angle 306 of the housing 22 in space. The resulting misalignment may be measured by sensors 78 and 80 and converted into and electrical signal. This electrical signal may be fed to the gain term 308. The output of the stabilized position loop 300 may be input into the mode switch 202 in FIG. 12 and used in the loop 200 to set or determine the angle 212 of the firearm 12 in space.

A user 310 may provide input to the controller 84 by adjusting a magnitude of the gain term 308. In some examples, the user 310 may adjust the gain term 308 by selecting buttons 68 on the control panel 66 and/or by selecting other suitable user input components. In one example, the higher a magnitude of the gain term 308, the more closely the firearm 12 may follow the housing 22. In some examples, if the user 310 is attempting to move rapidly from a first target to a second target, the user 310 may select to operate the stabilization system 14 at a high gain so the firearm 12 tracks closely with the housing 22. If the user 310 is aiming at a small target, the user may lower the gain term 308 so unintended movements of the user have little, if any, effect on the positioning of the firearm 12.

The gain term 308 may determine a gain term output in a linear or non-linear manner. In one example a slope of a gain term function may be low when the input is small and high when the input is large, such that the gain term function is a non-linear function.

Once a user has a target in a field of view of the sighting system 21, the user may select to operate the stabilization system 14 in the automatic aiming mode 218, to activate an automatic aiming system. In the automatic aiming mode 218, the user does not have control of the direction the firearm 12 is pointed as the stabilization system controls a position of the firearm 12 independent of the user. In the automatic aiming mode 218, the primary task of the user is to keep the housing 22 aligned with the firearm 12 and to fire the firearm 12. In the automatic aiming mode 218, the stabilization system 14 may move the firearm 12 to engage the target and to provides an indication of when the firearm 12 should be fired.

Figure 14:
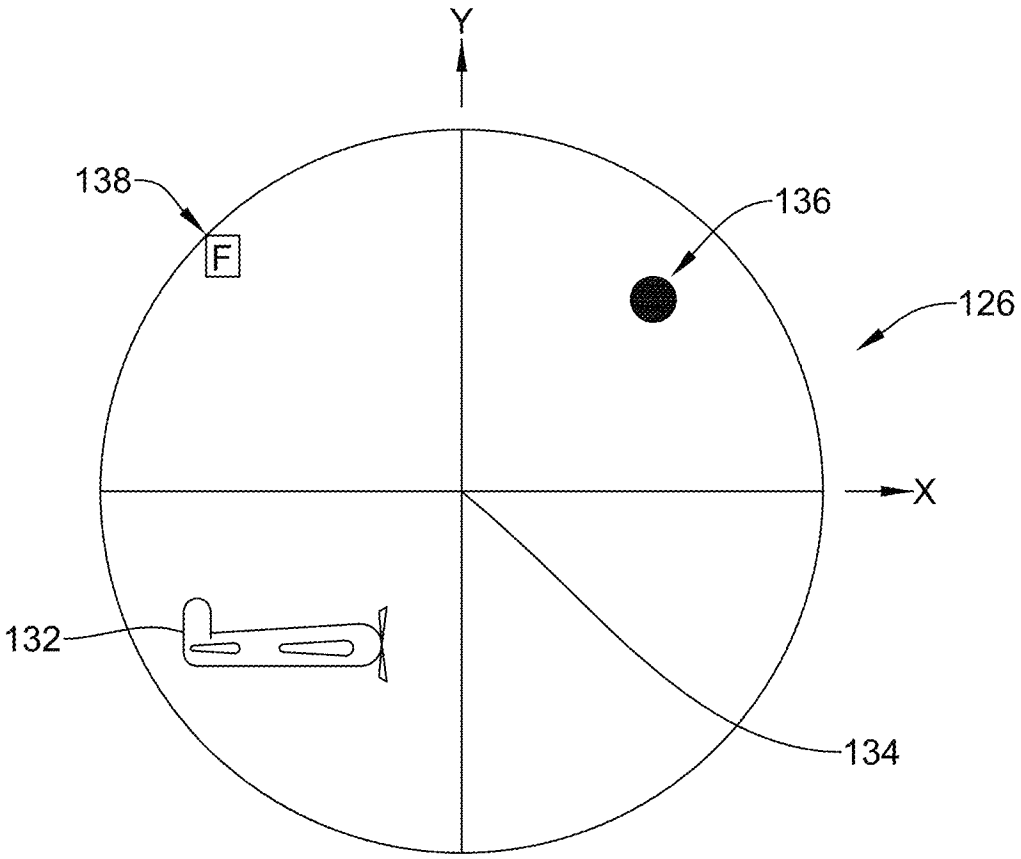
FIG. 14 depicts a schematic view of an illustrative display.

FIG. 14 depicts a schematic diagram of an illustrative configuration of the display 126 when the automatic aiming mode 218 has been selected. In some examples, the display 126 may be part of the sighting system 21, but other suitable configurations are contemplated.

When the user desires to hit a target 132 (in this example a moving unmanned air system (UAS) is illustrated, but other targets may be depicted on the display 126), the user may indicate the target 132 to the automatic aiming system (e.g., via a selection of a user input component) and the controller 84 and/or the sighting system 21 so the target can be tracked by an auto-tracker. The controller 84 may calculate elevation angle (e.g., an elevation angle for a distant target) and lead angle (e.g., a lead angle for a moving target) between the firearm 12 and the target 132. Based on the elevation and lead angles, the controller 84 may output control signals to adjust the firearm 12 to hit the target 132. FIG. 14 depicts cross-hairs 134 on the display 126 that are above and to the right of the moving target 132 as may be expected when the distant moving target 132 is moving left to right across the display 126.

As the stabilization system 14 adjusts the firearm 12 in space, the firearm 12 may eventually run out of travel angle relative to the housing 22 and hit the housing 22 unless the user adjusts housing 22 (e.g., manually adjusts, for example rotates, the housing 22 in space) to follow the firearm 12. To assist the adjustment by the user of the housing 22 to follow the firearm 12, a directional indicator may be provided to a user by the stabilization system 14. In some examples, a directional indicator 136 may be displayed on the display 126. As depicted in FIG. 14, the directional indicator 136 may be displaced from the cross hairs in the "X" direction in proportion to the output of the second sensor 80 and in the "Y" direction in proportion to the output of the first sensor 78. As such, the user may be directed to move the housing 22 in a direction of the directional indicator 136 with an intention of keeping the cross-hairs 134 centered on the directional indicator 136. The directional indicator 136 may be on the display 126, as depicted in FIG. 14, and/or may be provided as one or more visual, audible, or tactile indicators separate from the display 126.

The controller 84 operating in the automatic aiming mode 218 may determine the alignment of the firearm 12 is within a tolerance of the moving target 132 and light a fire indicator 138 (e.g., as depicted in the upper left of the display 126). The user may then pull the trigger 30 if so desired to fire the firearm 12 and hit the target 132. The fire indicator 138 may be on the display 126, as depicted in FIG. 14, and/or may be provided as a visual, audible, or tactile indicator separate from the display 126.

Figure 15:
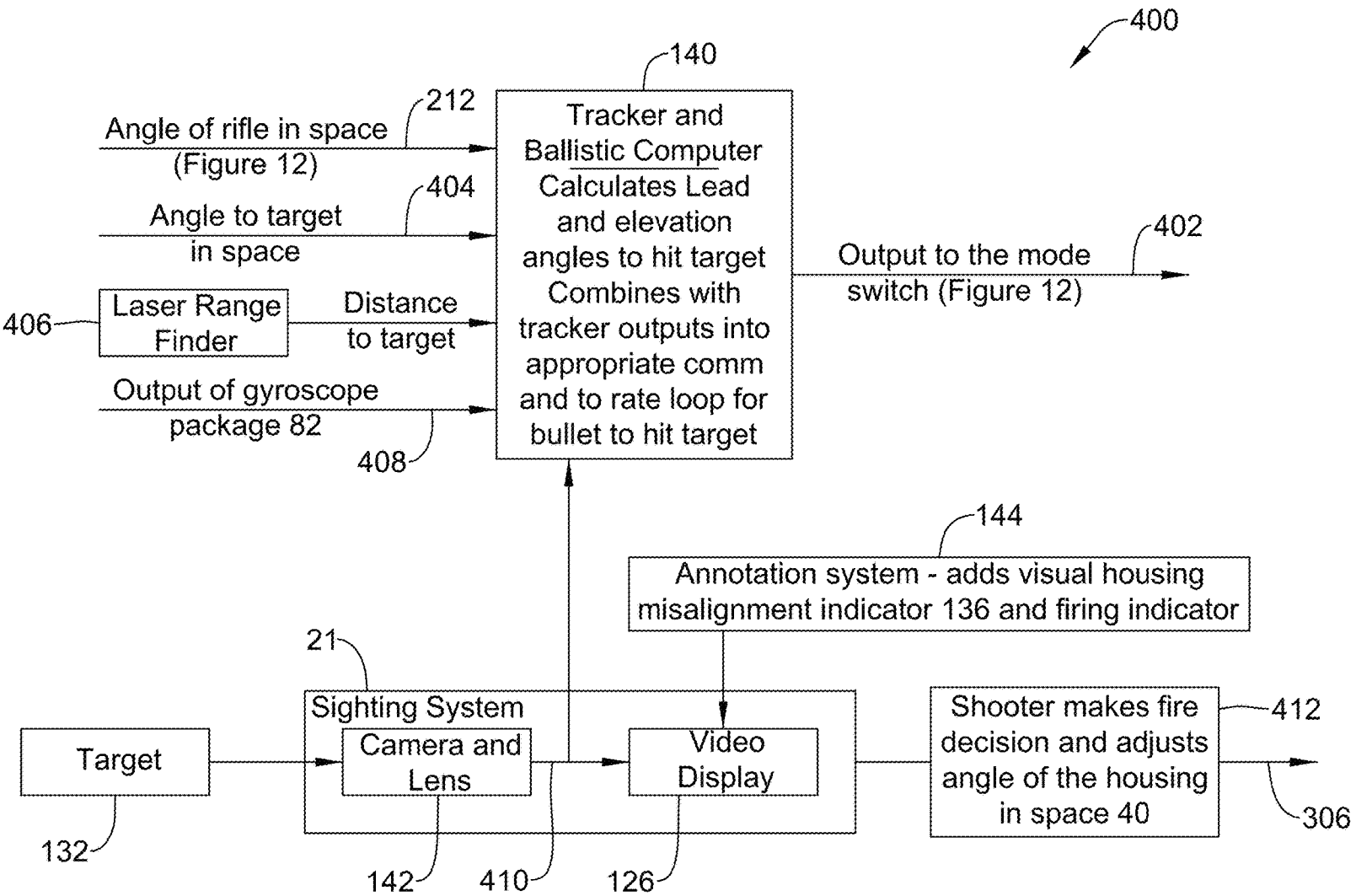
FIG. 15 depicts a schematic diagram of an illustrative control configuration.

FIG. 15 schematically depicts a diagram of an illustrative configuration of the automatic aiming loop 400 (e.g., control loop or operations) when the stabilization system 14 has been set by a user to the automatic aiming mode 218. As depicted in FIG. 15, a tracker and ballistic computer or component 140 of the controller 84 may be configured to accept one or more inputs. Example suitable inputs accepted by the tracker and ballistic component 140 of the controller 84 may include, but are not limited to, the angle 212 of the rifle in space, an angle 404 of the target 132 in space, a distance to the target 132 from a distancing component 406 (e.g., a laser range finder and/or other suitable distance calculating component) that may or may not be part of the sighting system 21, angular rates 408 of the firearm 12 as measured by the gyroscope package 82, video inputs 410 from a camera and/or lens component 142 of the sighting system 21 for analyzing and/or displaying on the display 126, and/or other suitable data inputs suitable for facilitating aiming of the firearm 12 at the target 132. In some examples, the video may be processed by a variety of target trackers and generate appropriate tracking rate commands to facilitate aiming the firearm 12 and/or tracking the target 132 with the firearm 12.

The tracker and ballistic component 140 of the controller 84 may process the inputs received into the necessary elevation and lead angles for determining a desired trajectory of a projectile (e.g., a bullet, etc.) from the firearm 12 such that the bullet intersects a trajectory of the target 132. The outputs of the tracker and ballistic component 140 of the controller 84, the elevation angles determined, and the lead angles determined may be processed by the controller 84 into a composite output 402 of the automatic aiming mode 218 for introduction into the mode switch 202 (see FIG. 12) and for use in the loop 200 to set the angle 212 of the firearm 12 in space.

As discussed with respect to FIG. 14, the automatic aiming mode 218 of the stabilization system or component 14 may include displaying data on the display 126. In some examples, when the automatic aiming mode 218 is selected, light from the target 132 may enter the camera and lens 142 and a video signal may be created that includes the target 132. The video signal that is created may be fed into the display 126 for viewing by the user 412. An annotation system 144 of the controller 84 may provide the fire indicator 138 and the directional indicator 136 to the image output by the display 126. The user 412 may observes the display 126, make a firing decision, and adjusts the angle 306 of the housing 22 in space to keep the directional indicator 136 centered or approximately centered on the cross hairs. The user 412 may then fire when desired.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Unless otherwise expressly stated, it is in no way intended that any method or technique set forth herein is to be construed as requiring that its steps be performed in a specific order. This holds for any possible non-express basis for interpretation, including matters of logic with respect to arrangement of steps or operational flow, plain meaning derived from grammatical organization or punctuation, and the number or type of embodiments described in the specification.

It should be understood that this disclosure is, in many respects, only illustrative. Changes may be made in details, particularly in matters of shape, size, and arrangement of steps without exceeding the scope of the disclosure. This may include, to the extent that it is appropriate, the use of any of the features of one example configuration being used in other configurations. The invention's scope is, of course, defined in the language in which the appended claims are expressed.

What is claimed is:

1. A handheld firearm system, comprising:

a firearm comprising:

a barrel;

a hammer release; and a buffer tube, the buffer tube is in-line with the barrel and extending proximal of the hammer release; and a stabilization system coupled with the firearm, the stabilization system comprising:

a housing extending around the barrel and the buffer tube;

a pivot mount at a location proximal of the hammer release, wherein the pivot mount receives the buffer tube and pivots with the buffer tube about one or more axes relative to the housing;

a motor system coupled with the buffer tube and configured to adjust the barrel relative to the housing; and a controller configured to receive a user selection of a mode from a plurality of predetermined modes and control the motor system based on the mode selected to adjust the barrel relative to the housing.

2. The handheld firearm system of claim 1, wherein the housing comprises:

a buttstock, wherein the buttstock houses the motor system and the buffer tube extends into the buttstock;

a hand stock fixed relative to the buttstock, wherein the barrel extends through the hand stock; and a pistol grip fixed relative to the buttstock and the hand stock.

3. The handheld firearm system of claim 1, wherein:

the stabilization system further comprises a trigger configured to engage the hammer release of the firearm as the trigger is actuated; and the trigger is configured to move with the housing and the hammer release is configured to move with the firearm relative to the housing.

4. The handheld firearm system of claim 1, wherein the firearm comprises a sighting system and the pivot mount is located proximal of the of the sighting system.

5. The handheld firearm system of claim 1, wherein the stabilization system further comprises one or more space rate sensors in communication with the controller and the one or more sensors are configured to sense movement of the pivot mount about a first axis and a second axis of the one or more axes.

6. The handheld firearm system of claim 1, wherein the motor system comprises:

a field assembly coupled to the buffer tube and comprising one or more magnets; and a coil assembly coupled to the housing and comprising a first set of coils configured to adjust the firearm about a first axis of the one or more axes and a second set of coils configured to adjust the firearm about a second axis of the one or more axes.

7. The handheld firearm system of claim 1, further comprising:

an imbalance counter-torque system configured to maintain a desired balance torque on the firearm about a first axis of the one or more axes during operation of the firearm.

8. The handheld firearm system of claim 1, further comprising:

a lock having a first lock component rigidly fixed relative to the firearm and a second lock component coupled with the housing, wherein when the first lock component is engaged with the second lock component, the firearm is configured to move with the housing and when the first lock component is disengaged from the second lock component, the firearm is configured to move relative the housing.

9. The handheld firearm system of claim 7, wherein the stabilization system further comprises a control panel in communication with the controller and having one or more selectable buttons.

10. The handheld firearm system of claim 1, wherein the plurality of predetermined modes includes a rate stabilized mode, a stabilized position mode, and an automatic aiming mode.

11. The handheld firearm system of claim 1, wherein when the selected mode from the plurality of predetermined modes is an automatic aiming mode, the controller is configured to initiate a visual directional indicator indicating a direction of movement of the housing to align the housing with the firearm.

12. The handheld firearm system of claim 1, wherein the firearm is selected from the group consisting of a rifle and a shotgun.

13. The handled firearm system of claim 1, further comprising:

one or more sensors configured to sense a rotation angle of the firearm relative to the housing.

14. The handheld firearm system of claim 1, wherein the controller is configured to output control signals to the motor system to automatically maintain the firearm in a target position.

15. A stabilization system configured to receive a firearm having a barrel, a buffer tube in-line with the barrel, and a hammer release, the stabilization system comprising:

a housing configured to receive the barrel and the buffer tube;

a pivot mount configured to be proximal of the hammer release when the barrel and buffer tube are received in the housing, wherein the pivot mount is configured to receive the buffer tube and pivot about one or more axes relative to the housing;

a motor system configured to couple with the buffer tube and adjust the barrel relative to the housing; and a controller configured to receive a user selection of a mode from a plurality of predetermined modes and control the motor system based on the mode selected to adjust the barrel relative to the housing.

16. The stabilization system of claim 15, wherein the housing comprises:

a buttstock housing the motor system, wherein the buttstock is configured to receive the buffer tube; and a hand stock rigidly fixed relative to the buttstock and configured to receive the barrel, wherein the firearm is configured to pivot about the pivot mount in the one or more axes and relative to the buttstock and the hand stock.

17. The stabilization system of claim 16, further comprising:

a pistol grip rigidly fixed relative to the buttstock and the hand stock; and a trigger configured to engage the hammer release of the firearm as the trigger is actuated, wherein the trigger is configured to move with the housing and relative to the hammer release.

18. The stabilization system of claim 15, further comprising:

a linear actuator configured to maintain a desired torque on the firearm about a first axis of the one or more axes during operation of the firearm.

19. The stabilization system of claim 15, further comprising:

a lock having a first lock component configured to rigidly couple with the barrel and a second lock component coupled with the housing, wherein when the first lock component is engaged with the second lock component, the firearm is configured to move with the housing and when the first lock component is disengaged from the second lock component, the firearm is configured to move relative the housing.

20. The stabilization system of claim 16, further comprising:

a control panel in communication with the controller and having one or more selectable buttons, wherein the control panel is covered when the first lock component is engaged with the second lock component and the control panel is uncovered when the first lock component is disengaged from the second lock component.

* * * * *